US012036444B2

(12) United States Patent
Neuhaus

(10) Patent No.: US 12,036,444 B2
(45) Date of Patent: Jul. 16, 2024

(54) MOTORIZED STRENGTH TRAINING APPARATUS WITH INTEGRATED CONTENT AND SETTINGS STREAM

(71) Applicant: OxeFit, Inc., Pensacola, FL (US)

(72) Inventor: Peter Neuhaus, Pensacola Beach, FL (US)

(73) Assignee: OxeFit, Inc., Plano, TX (US)

( * ) Notice: Subject to any disclaimer, the term of this patent is extended or adjusted under 35 U.S.C. 154(b) by 154 days.

(21) Appl. No.: 17/580,346

(22) Filed: Jan. 20, 2022

(65) Prior Publication Data

US 2023/0226413 A1 Jul. 20, 2023

(51) Int. Cl.

| | |
|---|---|
| ***A63B 24/00*** | (2006.01) |
| ***A63B 21/005*** | (2006.01) |
| ***A63B 71/06*** | (2006.01) |

(52) U.S. Cl.

CPC ..... *A63B 24/0087* (2013.01); *A63B 21/0058* (2013.01); *A63B 71/0622* (2013.01); *A63B 2024/009* (2013.01); *A63B 2225/20* (2013.01)

(58) Field of Classification Search

CPC ..... A63B 24/0087; A63B 21/0058; A63B 71/0622; A63B 2024/009; A63B 2225/20; A63B 2220/30; A63B 22/0605; A63B 24/0062; A63B 24/0075; A63B 2220/806; A63B 2225/50

See application file for complete search history.

(56) References Cited

U.S. PATENT DOCUMENTS

| | | | | |
|---|---|---|---|---|
| 11,170,886 | B2 | 11/2021 | Foley et al. | |
| 2020/0254311 | A1* | 8/2020 | Watterson | G09B 5/06 |
| 2021/0134458 | A1* | 5/2021 | Mason | G16H 40/67 |
| 2021/0138304 | A1* | 5/2021 | Mason | A63B 24/0075 |
| 2021/0291021 | A1* | 9/2021 | Orady | A63B 23/03541 |
| 2021/0394011 | A1 | 12/2021 | Neuhaus et al. | |
| 2022/0118316 | A1* | 4/2022 | Azaria | H04L 65/403 |

FOREIGN PATENT DOCUMENTS

WO WO-2021/236542 A1 11/2021

OTHER PUBLICATIONS

International Search Report and Written Opinion on PCT/US2023/010890 DTD Apr. 13, 2023.

* cited by examiner

*Primary Examiner* — Andrew S Lo
*Assistant Examiner* — Andrew M Kobylarz
(74) *Attorney, Agent, or Firm* — Foley & Lardner LLP

(57) ABSTRACT

An exercise apparatus includes a motor configured to generate a force experienced by a user of the exercise apparatus, a video monitor, and circuitry. The circuitry is configured to obtain an augmented video file from a remote streaming service. The augmented video file comprises a video and a plurality of settings. The augmented video file associates the plurality of settings with a plurality of time steps during a runtime of the video. The circuitry is also configured to cause the video monitor to display the video, and, at each of the plurality of time steps during the runtime of the video, control the motor in accordance with the setting associated with the time step.

20 Claims, 12 Drawing Sheets

MOTORIZED STRENGTH TRAINING APPARATUS WITH INTEGRATED CONTENT AND SETTINGS STREAM

BACKGROUND

In some aspects, the present disclosure relates to exercise equipment such as motorized training systems which use electric motors to generate forces experienced by users while performing exercises.

In some aspects, the present disclosure relates to video-based workout classes. Video-based workout classes (e.g., yoga, high intensity interval training) can be found on a variety of video streaming services. For example, video content is widely available in which a performer (coach, trainer, instructor) demonstrates and provides vocal instructions guiding viewers through a series of different exercises. Such video content enables on-demand and at-home access to fitness classes otherwise provided by in-person instructors in fitness studios or gyms on set schedules.

One downside of video-based workout classes is the burden placed on the viewer to manually configure any equipment used to perform the exercises shown in the videos. For example, video-based workout classes conventionally cannot help a user reconfigure the software setting for the equipment or choose different weights between exercise, assist a user in selecting an amount of weight that is appropriate for that user to use for a particular exercise, or otherwise ensure that equipment is arranged to facilitate a smooth flow through phases of the workout class.

SUMMARY

One implementation of the present disclosure is an exercise apparatus. The exercise apparatus includes a motor configured to generate a force experienced by a user of the exercise apparatus, a video monitor, and circuitry. The circuitry is configured to obtain an augmented video file from a remote streaming service. The augmented video file comprises a video and a plurality of settings. The augmented video file associates the plurality of settings with a plurality of time steps during a runtime of the video. The circuitry is also configured to cause the video monitor to display the video, and, at each of the plurality of time steps during the runtime of the video, control the motor in accordance with the setting associated with the time step.

In some embodiments, the circuitry is configured to control the motor in accordance with the setting associated with the time step by populating a value of a control variable based on the control setting from the augmented video file and controlling the motor using the value of the control variable. The circuitry may further configured to adjust the value of the control variable based on a user input.

In some embodiments, the plurality of settings are integrated with the video in the augmented video file such that a first setting is read by the circuitry when the video plays to a first time step of the plurality of time steps, the first time step associated with the first value, and a second setting is read by the circuitry when the video plays to a second time step of the plurality of time steps, the second time step associated with the second setting.

In some embodiments, the circuitry is configured to control the motor in accordance with the setting by populating a setpoint for the motor based on the setting and a user-specific scaling factor. The user-specific scaling factor may indicate a fitness level of the user, for example a one rep max of a user. In such embodiments, the setting may indicate a percentage and the circuitry may be configured to determine a setpoint for the force by multiplying the one rep max by the percentage and control the motor to drive the force to the setpoint.

In some embodiments, the exercise apparatus also includes a repositionable terminal between the motor and the user. The augmented video file may include an indication that the repositionable terminal should be repositioned at a particular time step in the runtime of the video. The circuitry may be configured to control the motor to facilitate repositioning of the repositionable terminal when the video plays to the particular time step. The exercise apparatus may also include a frame and a cable coupled to the motor, where the repositionable terminal affects a position from which the cable extends from the frame. Controlling the motor to facilitate repositioning of the repositionable terminal can include operating the motor to prevent slack in the cable or controlling the motor to prevent the motor from resisting movement of the cable caused by the repositioning of the repositionable terminal.

In some embodiments, the augmented video file also includes a first indication of a first moment during the runtime of the video at which to initiate collection of user performance data and a second indication of a second moment during the runtime of the video at which to end collection of user performance data. In some embodiments, the second moment is determined by an indication of a duration of a data collection period from the first moment. The circuitry may be configured to collect, while the video plays from the first moment to the second moment, a batch of the user performance data. The circuitry may be configured to encode the batch of user performance data with an indicator of an associated type of exercise and upload the batch of the user performance data to a remote server after reading the second indication. In some embodiments, data collection starts when a user provides an input to the exercise apparatus and ends when a duration or other criterion is met.

In some embodiments, the control variable indicates a target value of the force. In some embodiments, the augmented video file also includes a plurality of control logic selections associated with the plurality of time steps during the runtime of the video. In such embodiments, each control logic selection indicates a selection of a control logic from a set of available control logic and the circuitry is configured to control, at each of the plurality of time steps during the runtime of the video, the motor by executing the control logic indicated by the control logic selection associated with the time step. The set of available control logic can include first control logic causing the circuitry to control the motor to cause the force to be constant and second control logic causing the circuitry to control the motor to cause the force to be greater during an eccentric phase of an exercise compared to a concentric phase of the exercise.

Another implementation of the present disclosure is a system. The system includes an exercise apparatus that includes a video monitor, a motor configured to generate a force experienced by a user of the exercise apparatus, and circuitry configured to control the motor using a control variable. The system also includes a database storing a plurality of augmented video files each comprising a video and values for the control variable associated with a plurality of time steps during a runtime of the video. The circuitry is further configured to stream the plurality of augmented video files from the database, cause the video monitor to display the videos, and control the motor at the plurality of time steps during the runtime of the videos using the values of the control variable associated with the plurality of time steps.

In some embodiments, the database is located remotely from the exercise apparatus and the circuitry is communicable with the database via the internet. The plurality of values for the control variable are integrated with the videos in the augmented video files such that a first value of the plurality of values is read by the circuitry when a first video of a first augmented video file plays to a first time step of the plurality of time steps (the first time step associated with the first value) and a second value of the plurality of values is read by the circuitry when the first video plays to a second time step of the plurality of time steps (the second time step associated with the second value).

In some embodiments, the circuitry is configured to control the motor using the control variable by calculating a setpoint for the motor based on a current value for the control variable and a user-specific scaling factor. The user-specific scaling factor may indicate a fitness level of the user. The database may store a plurality of user profiles for a plurality of users, with the plurality of user profiles including values of the user-specific scaling factor for the plurality of users.

In some embodiments, the control variable indicates a target value of the force. In some embodiments, the augmented video files also includes a plurality of control logic selections associated with the plurality of time steps during the runtime of the video. In such embodiments, each control logic selection indicates a selection of a control logic from a set of available control logic and the circuitry is configured to control the motor at the plurality of time steps by executing the control logic indicated by the control logic selection associated with the time steps.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Referring generally to the figures, an exercise apparatus and methods relating thereto are shown. In particular, an exercise apparatus configured as a motorized strength training apparatus is shown. In the motorized strength training apparatus described herein, an electric motor operates to generate a tension in a cable. An exercise implement such as a handle, bar, etc. can be connected to the cable such that the tension is communicated to the exercise implement and a force is exerted on a user holding (or otherwise in contact with) the exercise implement.

One aspect of the present disclosure is a determination that some electric motors may be well-suited for relatively low-force and relatively high-speed changes in tension and would be best for relatively-light-force exercises (e.g., less than 50 kilograms), but may not be able to achieve the same level of performance when higher forces are desired for an exercise (e.g., more than 50 kilograms), while other motors may have different performance characteristics (e.g., provide high forces but do not provide smooth performance at lower forces). Accordingly, it would be advantageous to provide features which extend the range of capabilities of a given electric motor to enable a larger number of exercises, a larger range of resistances, etc. Achieving such an extension without adding internal complexity to the motor (e.g., gearing, etc.) may also be desirable.

As described in detail below, the figures show an exercise apparatus which allows a user to select between a first configuration in which the force on an exercise implement (handle, bar, etc.) held by the user corresponds to (e.g., is substantially equal to) the tension in the cable and a second configuration in which the force on the exercise implement corresponds to double the tension on the cable due to a routing of the cable across multiple pulleys. This selective doubling of the force generated by the motor enables a single motor to be used to generate suitable forces for a wider range of exercises than in embodiments without such features. These and other advantages of the present disclosure are described in further detail below with reference to the figures.

Figure 1:
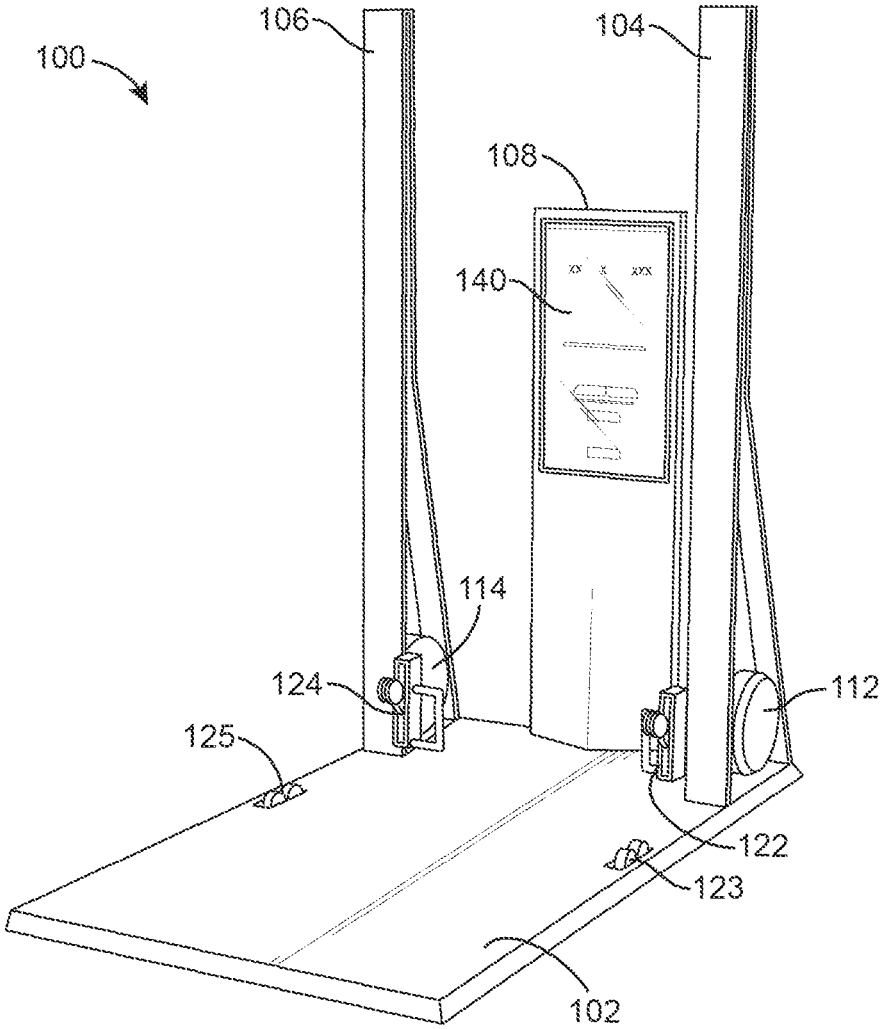
FIG. 1 is a perspective view of an exercise apparatus, according to some embodiments.

Referring now to FIG. 1, an exercise apparatus 100 is shown, according to some embodiments. The exercise apparatus 100 includes a base platform 102, a first stanchion 104 extending vertically from the base platform 102 proximate a first end of the base platform 102, a second stanchion 106 extending vertically from the base platform 102 proximate the first end of the base platform 102, a display console 108 coupled to the base platform 102 and positioned between the first stanchion 104 and the second stanchion 106. The exercise apparatus can also include a bench selectively positionable on the base platform 102. The exercise apparatus 100 also includes a first motor 112 positioned on the base platform 102 at the first stanchion 104 and a second motor 114 positioned on the base platform 102 at the second stanchion 106.

The exercise apparatus 100 also includes a first cable 118 (shown in FIGS. 2-4) extending from the first motor 112 and a second cable 120 (shown in FIGS. 3-5) extending from the second motor 114. The exercise apparatus 100 also includes a first terminal 122 coupled to the first stanchion and repositionable along the first stanchion 104, and a first set of pulleys 123 positioned at the base platform 102. In the state shown in FIG. 1, the first cable 118 extends from the first motor 112 along the first set of pulleys 123 to the first terminal 122, for example via the routing shown in FIG. 2 and described in detail below with reference thereto.

The exercise apparatus 100 also includes a second terminal 124 coupled to the second stanchion 106 and repositionable along the second stanchion 106, and a second set of pulleys 125 positioned at the base platform 102. In the state shown in FIG. 1, the second cable 120 extends from the second motor 114 along the second set of pulleys 125 to the second terminal 124.

As shown in FIG. 1, the base platform 102 is substantially planar is configured to stably rest on a floor or other ground surface to provide a stable foundation for the exercise apparatus 100. The base platform 102 can define an exercise surface on which a user can perform one or more exercise and/or on which the bench 110 can be positioned. In some embodiments, the base platform 102 is configured to be at least partially foldable into an out-of-use configuration in which the base platform 102 is folded up and away from the floor or ground under the base platform 102 (thereby reducing the space occupied by the exercise apparatus 100 when not in use).

The display console 108 may be configured to display information relating to operation of the exercise apparatus 100 to a user. As shown in FIG. 1, the display console 108 includes a screen 140 (e.g., LED screen). In some embodiments, the screen 140 is a touchscreen configured to accept user input. In other embodiments, one or more additional buttons, keys, toggles, etc. are included on the display console 108 to receive user input. In some embodiments, the display console 108 includes one or more speakers configured to emit sounds relating to operation of the exercise apparatus 100. In some embodiments, the exercise apparatus 100 alternatively or additionally includes a virtual reality or augmented reality headset configured to be worn by a user and to display information relating to operation of the exercise apparatus 100 to the user. In some embodiments, the display console 108 houses a controller for the exercise apparatus 100.

The first stanchion 104 and the second stanchion 106 extend upwards from the base platform 102 and are spaced apart from one another near an end of the base platform 102. The first stanchion 104 and the second stanchion 106 are shown as being substantially symmetric across a center line of the base platform 102. As shown in FIG. 1, the first stanchion 104 and the second stanchion 106 are substantially the same height. The first stanchion 104 and the second stanchion 106 may be approximately six feet tall, for example with a height in a range between five feet and seven feet, as in the example of FIG. 1. In other embodiments, the first stanchion 104 and the second stanchion 106 may be shorter, for example with a height in a range between two feet and four feet.

The first terminal 122 is coupled to the first stanchion 104 and is configured to be selectively repositioned along the first stanchion 104. For example, the first terminal 122 may include a projection that rides along a groove or slot of the first stanchion 104 (or vice-versa) and can be selectively held in place at various heights using a pin configured to engage apertures of the first stanchion 104. The first terminal 122 can include a handle to facilitate repositioning of the first terminal 122. The second terminal 124 is coupled to the second stanchion 106 and is configured to be selectively repositioned along the second stanchion 106. For example, the second terminal 124 may include a projection that rides along a groove or slot of the second stanchion 106 (or vice-versa) and can be selective held in place at various heights using a pin configured to engage apertures of the second stanchion 106. The second terminal 124 can include a handle to facilitate repositioning of the second terminal 124. Accordingly, the first terminal 122 and the second terminal 124 can be repositioned (e.g., manually by a user) to various heights along the first stanchion 104 and the second stanchion 106, i.e., at various heights above the base platform 102. In some embodiments, actuators (e.g., linear actuators) are included in the first stanchion 104 and the second stanchion 106 to automatically move the first terminal 122 and the second terminal 124.

The first motor 112 is shown as being positioned on the base platform 102 at a bottom end of the first stanchion 104. The first motor 112 is operationally coupled to the first cable 118 such that the first motor 112 can generate tension in the first cable 118. In some examples, the first motor 112 can include an electric motor coupled to a spool such that the electric motor operates to generate a torque that rotates the spool. In such examples, the spool is coupled to the first cable 118 such that the first cable 118 can be repeatedly wound and unwound from the spool of the first motor 112 by operation of the first motor 112.

The first motor 112 is configured to controllably generate a force that acts both acts to retract the first cable 118 towards the first motor 112 and to resists the first cable 118 from being pulled out (unspooling, releasing) from the first motor 112. Thus, as detailed below, the first motor 112 can provide a controllable tension in the first cable 118 in different phases (e.g., concentric and eccentric phases) of exercises performed using the exercise apparatus 100, for example providing different amounts of tension in different phases or otherwise dynamically altering the tension. In some embodiments, the first motor 112 includes a permanent magnet direct current motor. In various embodiments, the first motor 112 includes a belt, a gear, a set of gears, various gearing, etc.

The second motor 114 is shown as being positioned on the base platform 102 at a bottom end of the second stanchion 106. The second motor 114 is operationally coupled to the second cable 120 such that the second motor 114 can generate tension in the second cable 120. Other than acting on the second cable 120 rather than the first cable 118, the second motor 114 is configured substantially the same as the first motor 112 in the examples shown.

Figure 2:
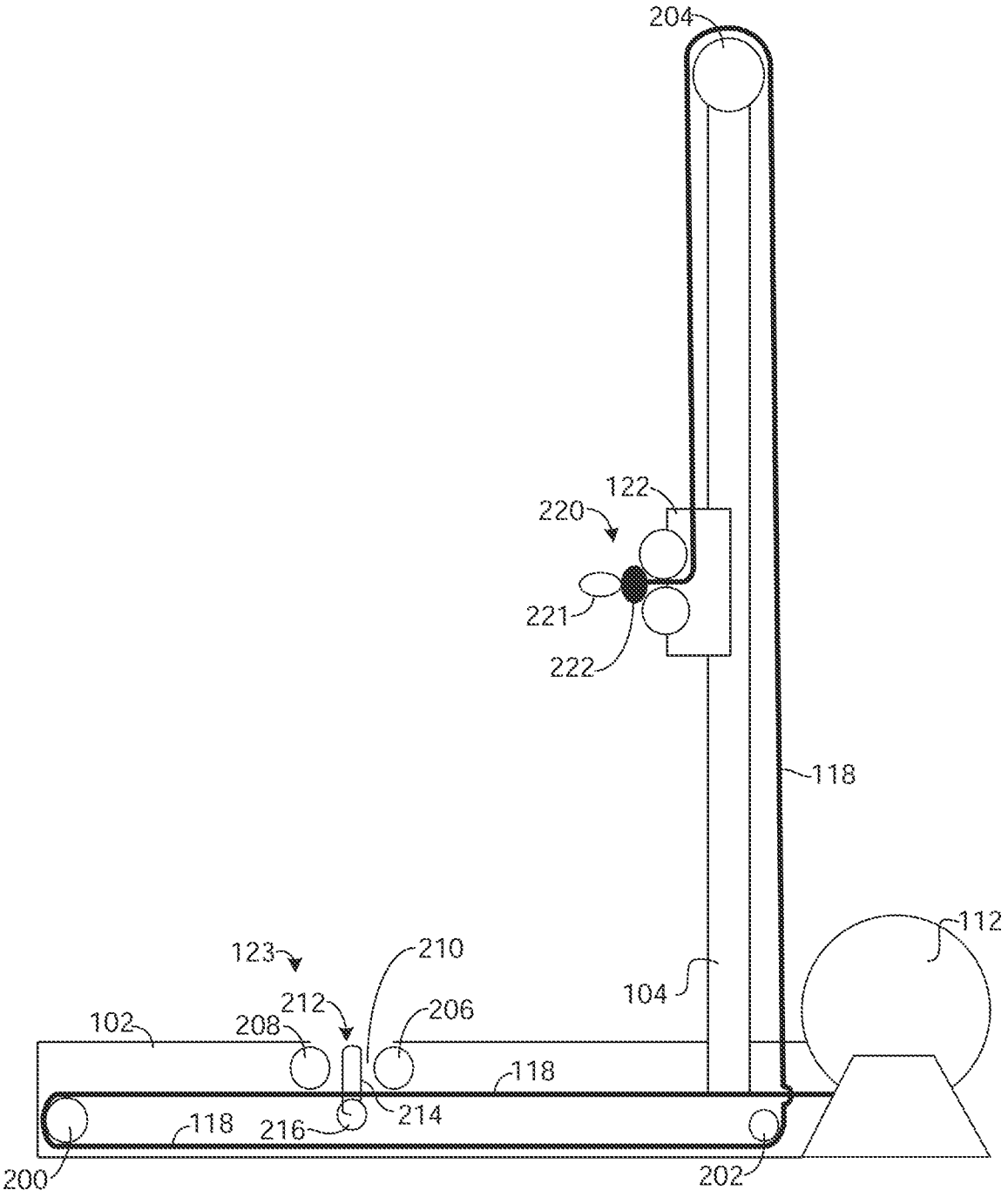
FIG. 2 is a schematic side view of the exercise apparatus of FIG. 1, according to some embodiments.

Referring now to FIG. 2, a schematic side-view showing a routing of the first cable 118 from the first motor 112 to the first terminal 122 via the first set of pulleys 123 is shown, according to some embodiments. As shown in FIG. 2, the exercise apparatus also includes a base pulley 200, a lower stanchion pulley 202, and an upper stanchion pulley 204 around which the first cable 118 is routed as detailed below. While FIG. 2 shows the routing of the first cable 118, the second cable 120 may be similarly routed and the second cable 120, second terminal 124, second set of pulleys 125, etc. may be configured the same as described below for the first cable 118, first terminal 122, first set of pulleys 123, etc., and additional pulleys corresponding to the base pulley 200, lower stanchion pulley 202, and the upper stanchion pulley 204 may be provided for the second cable 120.

As shown in FIG. 2, the first cable 118 extends out from the first motor 112 along the base platform 102 (e.g., within the base platform 102) in a longitudinal direction of the base platform 102 and approximately perpendicular to the first stanchion 104. The first cable 118 first passes through the first set of pulleys 123 before reaching the base pulley 200. The base pulley 200 is located at the base platform 102 such that the first set of pulleys 123 are between the first stanchion 104 and the base pulley 200. The cable 118 is routed around the base pulley 200 such that the base pulley 200 reverse the direction of the cable 118 back toward the first stanchion 104.

FIG. 2 further shows that the first cable 118 is routed from the base pulley 200 to the lower stanchion pulley 202, which is located at a bottom of the first stanchion 104 (e.g., proximate an intersection between the first stanchion 104 and the base platform 102). The lower stanchion pulley 202 redirects the first cable 118 upwards along the first stanchion to the upper stanchion pulley 204, which is located at a top end of the first stanchion 104. The cable 118 thus extends along substantially the entire height of the first stanchion 104. The upper stanchion pulley 204 redirects the first cable 118 downwards to the first terminal 122. The cable 118 thus sequentially passes the first set of pulleys 123, the base pulley 200, the lower stanchion pulley 202, and the upper stanchion pulley 204 to reach the first terminal 122 from the first motor 112.

As shown in FIG. 2, the first set of pulleys 123 includes a pair of fixed pulleys (first fixed pulley 206 and second fixed pulley 208) which are shown as fixed in position (i.e., not translatable) relative to the base platform 102. The first fixed pulley 206 may be rotatable about the axis of the first fixed pulley 206 and the second fixed pulley 208 may be rotatable about the axis of the second fixed pulley 208. The first fixed pulley 206 is spaced apart from second fixed pulley 208 in the direction of travel of the cable 118 at the first set of pulleys 123 (i.e., in the longitudinal direction of the base platform 102) such that a gap 210 is provided between the first fixed pulley 206 and the second fixed pulley 208.

The first set of pulleys 123 is also shown as including a first connection point 212. The first connection point includes a loop 214 through which the cable 118 extends and a moveable pulley 216. The moveable pulley 216 and the loop 214 are moveable relative to the first fixed pulley 206 and the second fixed pulley. The loop 214 is configured to be connected to an exercise implement, for example a handle or bar held by a user for performing an exercise. The moveable pulley 216 is configured (e.g., sized) to be selectively moved (e.g., by a user) through the gap 210 by action of the user on the loop 214 (e.g., via the exercise implement).

When the first connection point 212 and the moveable pulley 216 are in the position shown in FIG. 2, the first connection point 212 and the moveable pulley 216 allow the cable 118 to pass by without substantially redirecting the cable 118. Action of the cable 118 and/or gravity may pull the moveable pulley 216 and the first connection point 212 into the state shown in FIG. 2 when an external force is not exerted on the first connection point 212 (e.g., when a user is not interactive with the first connection point 212) such that FIG. 2 may be considered as showing a default position for the first connection point 212. In some embodiments, the moveable pulley 216 (e.g., a housing or external surface thereof) is of a ferrous metal and a magnet (e.g., permanent magnet) is located in the base 102 (e.g., proximate the position of 216 as in FIG. 2). In such embodiments, the magnet holds the moveable pulley 216 in place when not in use and is configures such that a user can overcome the magnetic force to initiate movement of the moveable pulley 216 through the gap 210.

Figure 3:
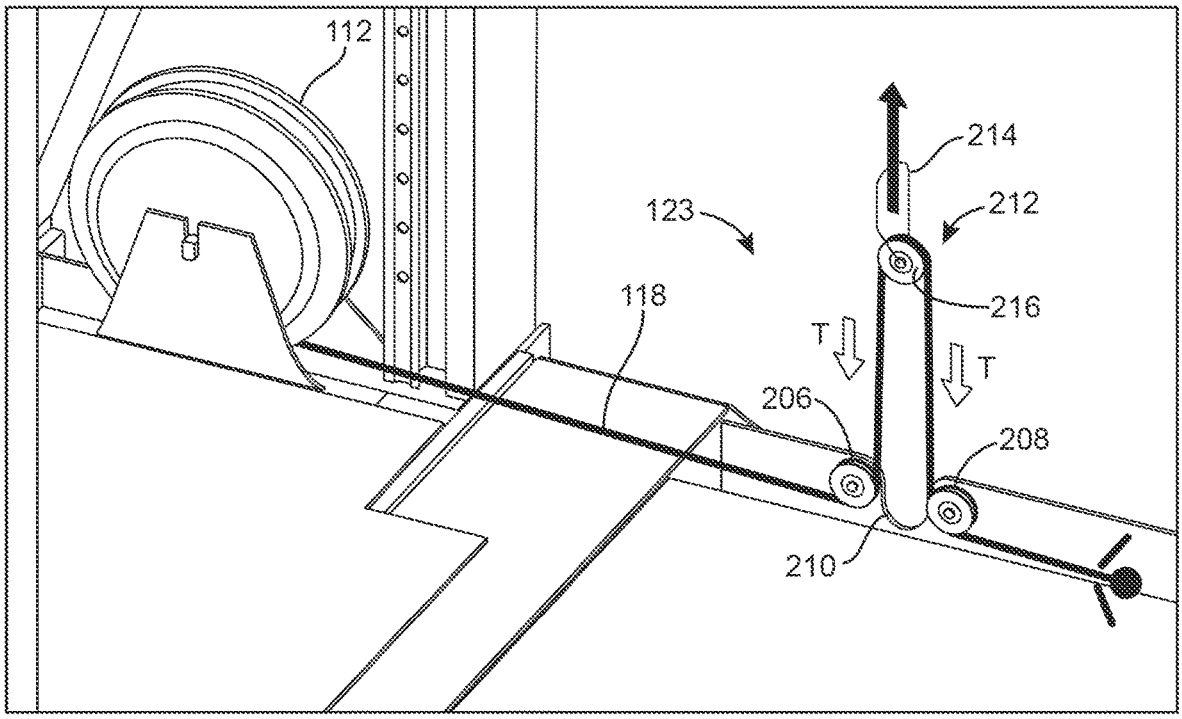
FIG. 3 is a perspective view of a portion of the exercise apparatus of FIG. 1 in use to provide a multiplication of a force generated by a motor of the exercise apparatus, according to some embodiments.

FIG. 3 illustrates the cable routing at the first set of pulleys 123 in a scenario where a user exerted an upwards force on the first connection point 212 to draw the moveable pulley 216 through the gap 210 between the first fixed pulley 206 and the second fixed pulley 208, according to some embodiments. The routing of the cable 118 and the forces provided on the first connection point 212 in such a scenario is described in detail below with reference to FIG. 3.

Still referring to FIG. 2, the distal end of the cable 118 is shown as including a second connection point 220. The second connection point 220 includes a loop (ring, etc.) 221 to which an exercise implement can be selectively connected. The second connection point 220 also includes a stopper 222 configured to prevent retraction of the distal end of the cable 118 past the first terminal 122 toward the first motor 112. The stopper 222 can be a ball of rubber, plastic, metal, etc. that is too large to fit though an opening in first terminal 122 through which the first cable 118 extends (e.g., having a diameter multiple times that of the cable 118). The length of cable between the first terminal 122 and the first motor 112 can change with adjustment of the position of the first terminal 122 along the first stanchion 104 and by movement of the first connection point 212 as described with reference to FIGS. 3-5. The stopper 222 is positioned so that the second connection point 220 can be pulled away from the first terminal 122 to cause extension of the cable 118 out from the first terminal 122. Operation of the motor 112 pulls the stopper 222 into contact with the first terminal 122 absent an external force (e.g., from a user) on the second connection point 220.

Figure 6:
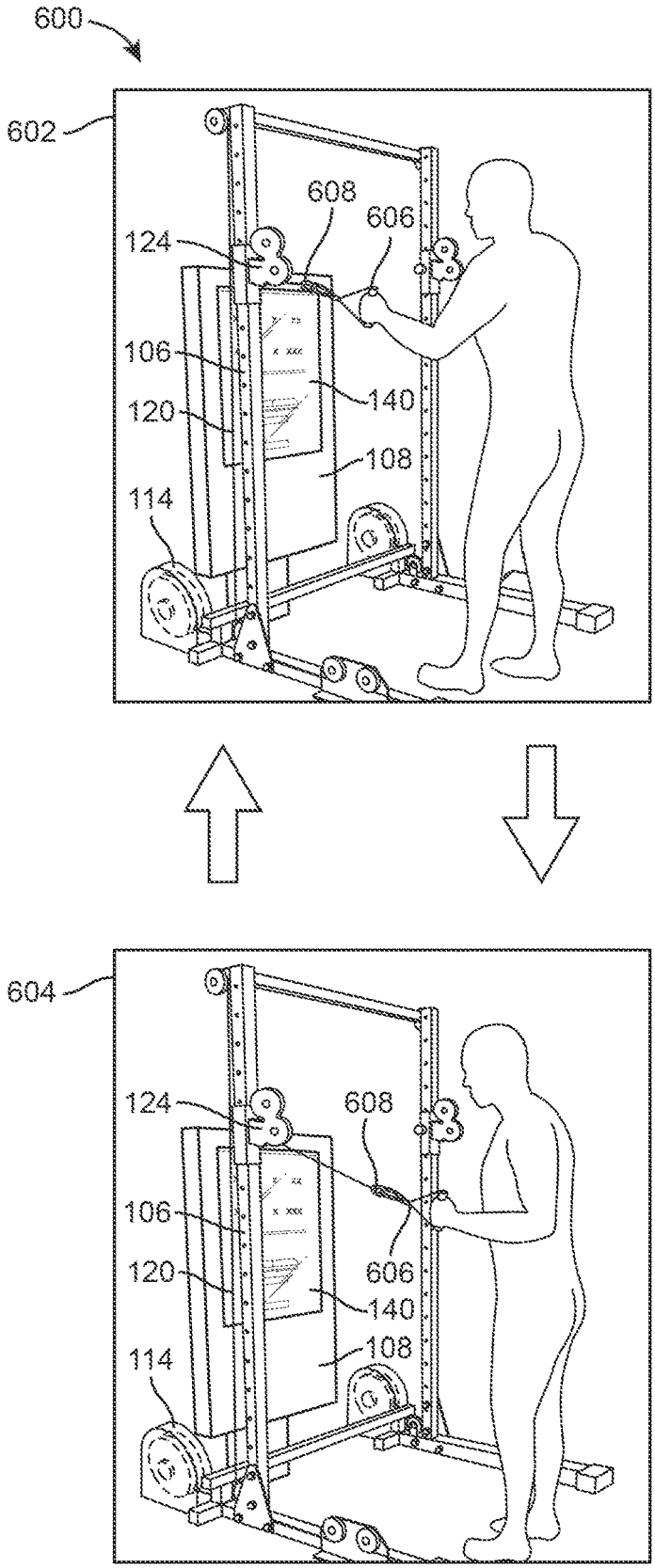
FIG. 6 is a storyboard-style illustration of operation of the exercise apparatus of FIG. 1 to provide a one arm row strength exercise, according to some embodiments.

The first terminal 122 and the second connection point 220 interact to allow an exercise to be performed by pulling on an exercise implement connected to the second connection point 220 (as shown in FIG. 6 and described with reference thereto) while preventing retraction of the cable past the first terminal 122. In such exercises, the force exerted at the second connection point 220 and experienced by a user corresponds to the tension generated by the motor 112 in substantially a one-to-one relationship (i.e., the tension in the first cable 118 is substantially equal to the force on the second connection point 220). A user can select to use the second connection point 220 for exercises when such levels of force and cable speed are suitable for performance of corresponding exercises.

Referring now to FIG. 3, a schematic perspective illustration of a portion of the exercise apparatus 100 is shown, in a scenario where the first connection point 212 is in use and according to some embodiments. As shown in FIG. 3, the moveable pulley 216 is pulled above the first fixed pulley 206 and the second fixed pulley 208 through the gap 210 between the first fixed pulley 206 and the second fixed pulley 208.

The cable 118 is routed sequentially under the first fixed pulley 206, over the moveable pulley 216, and under the second fixed pulley 208. When the moveable pulley 216 is above the first fixed pulley 206 and the second fixed pulley 208 as shown in FIG. 3, the first cable 118 extends downwards from the moveable pulley 216 to the first fixed pulley 206 and from the moveable pulley 216 to the second fixed pulley 208. Moving the moveable pulley 216 causes a change in length of the first cable 118 between the motor 112 and the stopper 222 at the distal end of the first cable 118 (by drawing the first cable 118 out from the motor 112), while the distal end of the first cable 118 remains in a static position (e.g., the stopper 222 engages the first terminal 122 such that the stopper 222 cannot be pulled closer to the second fixed pulley 208).

The first motor 112 operates to generate a tension T in the first cable 118. When arranged as in FIG. 3, the relationship between the first fixed pulley 206 and the moveable pulley 216 is such that the tension T is present in the subsection of the first cable 118 between the first fixed pulley 206 and the moveable pulley 216, pulling the moveable pulley 216 toward the first fixed pulley 206. Additionally, the tension T is also present in the subsection of the first cable 118 between the second fixed pulley 208 and the moveable pulley 216, pulling the moveable pulley 216 toward the second fixed pulley 208. A total force on the moveable pulley 216 is thereby created which corresponds to double the tension T (e.g., F=2*T) generated by the motor. The set of pulleys 123 thereby acts as a force multiplier to double the force output by the motor.

Figure 4:
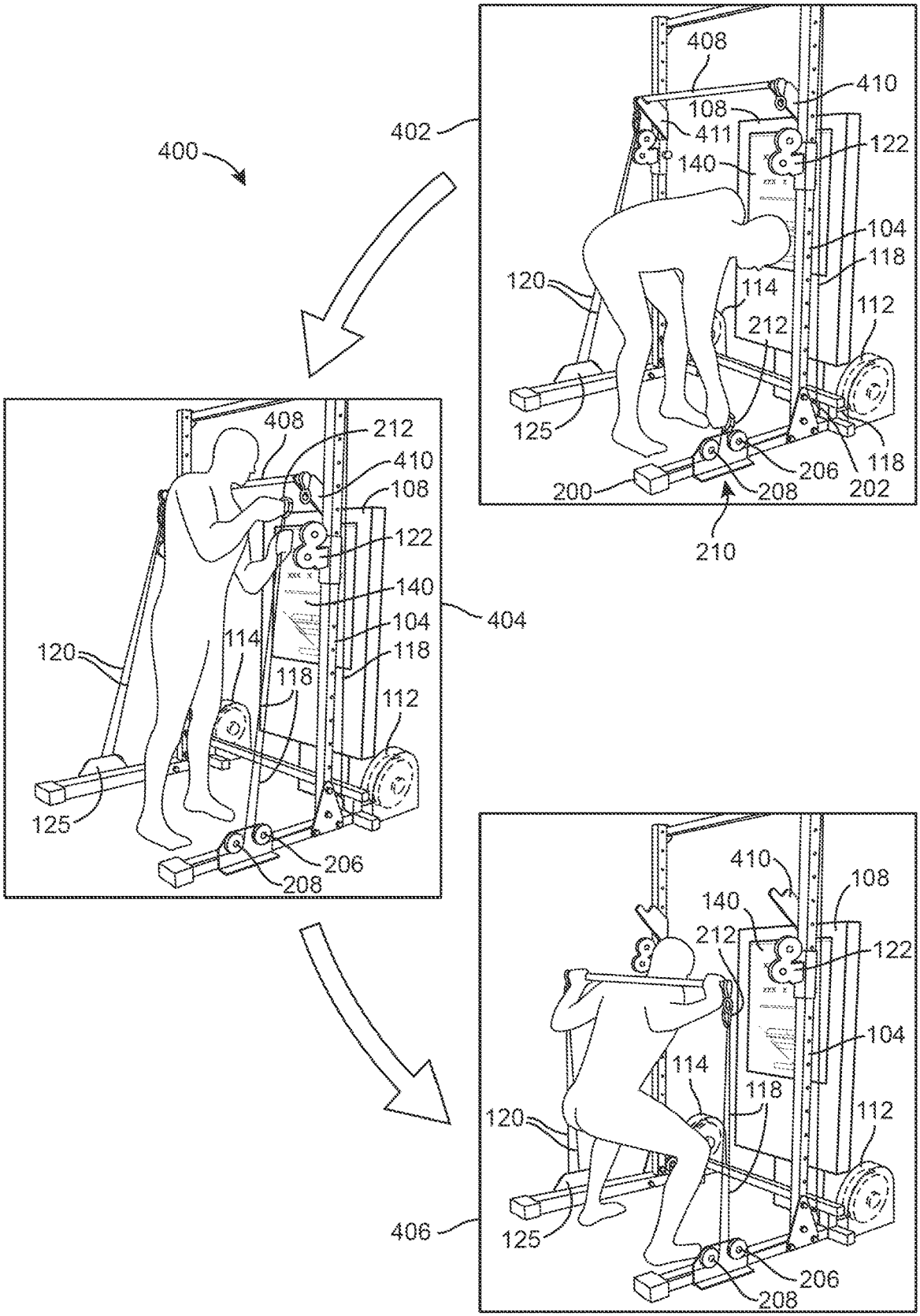
FIG. 4 is a storyboard-style illustration of operation of the exercise apparatus of FIG. 1 to provide a squat exercise, according to some embodiments.
Figure 5:
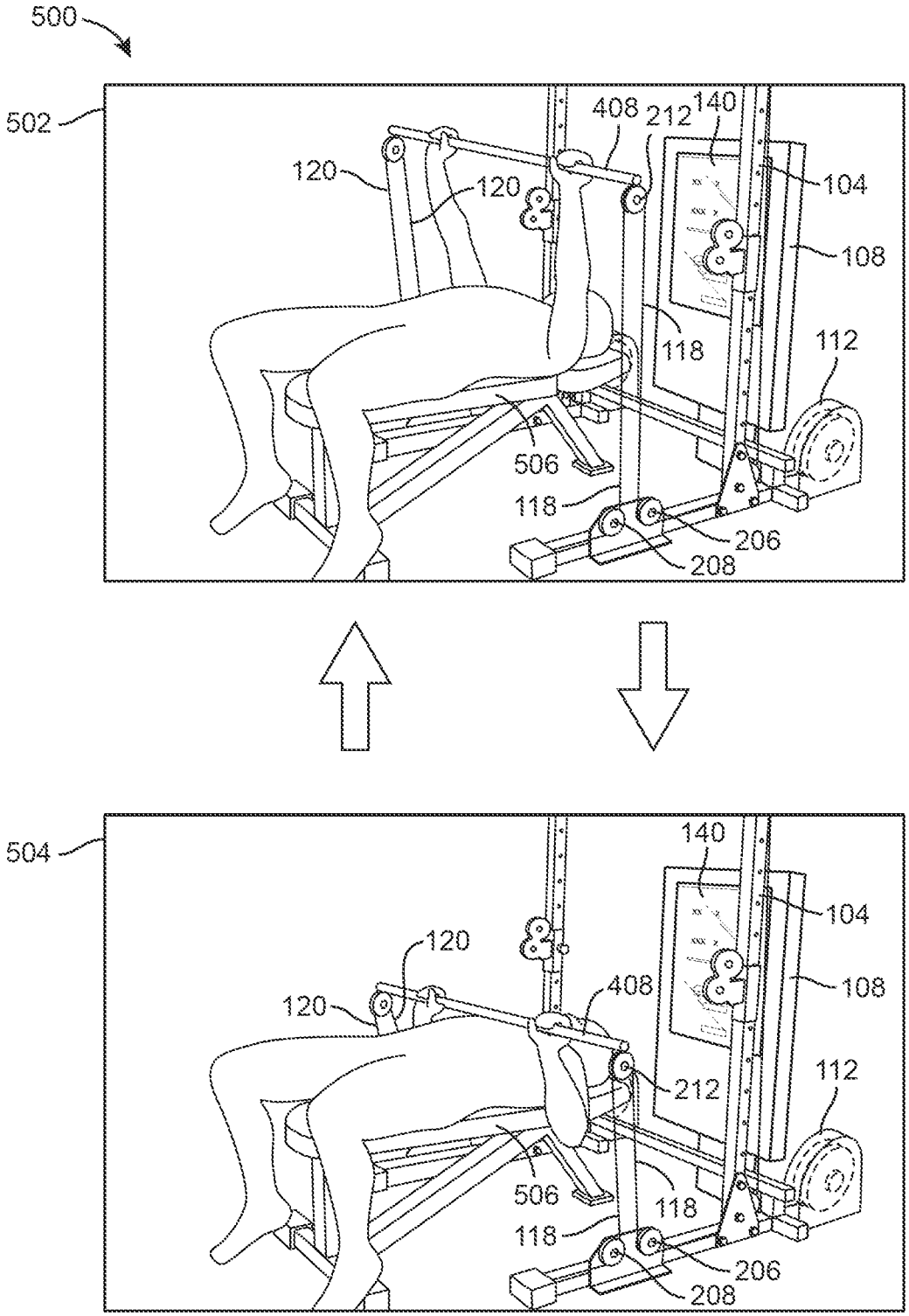
FIG. 5 is a storyboard-style illustration of operation of the exercise apparatus of FIG. 1 to provide a bench press, according to some embodiments.

The loop 214 is coupled to the moveable pulley 216 and is configured to be coupled to an exercise implement such as a bar (e.g., as shown in FIGS. 4-5), grip, handle, etc. For example, a carabineer or other quick-release clip can be engaged with the loop 214 to couple the exercise implement to the loop 214 for performance of an exercise using the exercise implement. In other embodiments, the loop 214 is formed as a handle, grip, etc. configured to be held by a user during performance of an exercise. The loop 214 is coupled to the moveable pulley 216 such that the force on the moveable pulley 215 from the first cable 118 (i.e., approximately double the tension T in the cable 118) is communicated to the loop 214 and, when connected, to an exercise implement connected thereto. Exercises performed using the first connection point 212 with a bar connected to the loop 214 are shown in FIGS. 3-4 and described with reference thereto below.

Referring now to FIG. 4, a storyboard-style illustration 400 of operation of the exercise apparatus 100 for performance of a squat exercise is shown, according to some embodiments. The illustration 400 includes a first frame 402, a second frame 404, and a third frame 406 showing steps of a process of operating the exercise apparatus 100.

In the first frame 402, the exercise apparatus 100 is shown as including a bar 408 resting on a first cradle 410 mounted on the first stanchion 104 and on a second cradle 411 mounted on the second stanchion 106. In the first frame 402, the bar 408 is connected to the second cable 120, but not connected to the first cable 118. The first frame 402 and the second frame 404 combine to show a process for connecting the first cable 118 to the bar 408 to enable the bar 408 to be used for performance of an exercise subject to forces generated by the first motor 112 and the second motor 114. During the first frame 402, instructions can be displayed on the screen 140 of the display console 108 guiding the user through the step of connecting the first cable 118 to the bar 408. For example, a video may be played on the screen 140 in which an instructor provides visual and/or audio (e.g., emitted by a speaker of the display console 108).

As illustrated in the first frame 402, a user can grab the first connection point 212 from its position between the first fixed pulley 206 and the second fixed pulley 208, for example via the gap 210 between the first fixed pulley 206 and the second fixed pulley 208. In the first frame 402, the user begins to pull the first connection point 212 upwards through the gap 210. Drawing the first connection point 212 upwards pulls on the first cable 118, causing additional length of the first cable 118 to be played out from the first motor 112. The first motor 112 may operate in a setup or transition mode (e.g., in response to an indication or variable in an augmented video file being streamed to the display console 108 as described below) to allow length of the first cable 118 to be relatively easily extracted from first motor 112 during a setup or transition phase before or between exercises (e.g., while substantially avoiding slack in the first cable 118 by providing a small tension), thereby facilitating the user in drawing the first connection point 212 upwards through the gap 210 and away from the first fixed pulley 206 and the second fixed pulley 208.

From the first frame 402 to the second frame 404, the user continues to move the first connection point 212 away from the first fixed pulley 206 and the second fixed pulley 208 and to the bar 408. When the first connection point 212 reaches the bar 408, the first connection point 212 can be connected to the bar 408. For example, the loop 214 of the first connection point 212 may include a carabineer or other type of clip or connector configured to selectively engage with a loop, ring, slot, hole, etc. of the bar 408. As another example, the bar 408 may include a carabineer or other type of clip or connector configured to selectively engage with the loop 214 of the first connection point 212. During the second frame 404, instructions can continue to be displayed on the screen 140 of the display console 108 guiding the user through the step of connecting the first cable 118 to the bar 408, for example in the form of a video played on the screen 140.

10058 The second frame 404 illustrates a user connecting the bar 408 to the first connection point 212, thereby creating a mechanical connection between the bar 408 and the first cable 118. Once connected, the tension in the first cable 118 is communicated to the bar 408, from both the section of the first cable 118 between the bar 408 and the first fixed pulley 206 and the section of the first cable 118 between the bar 408 and the second fixed pulley 208. The bar 408 is pulled towards the first fixed pulley 206 by the tension T created by the first motor 112 and toward the second fixed pulley 208 by the tension T created by the first motor 112. Due to the routing of the first cable 118, the force generated by the first motor 112 is thereby doubled for communication to the bar 408. The second cable 120 can be connected to the bar 408 in a similar manner, such that force generated by the second motor 114 is also doubled for communication to the bar 408.

The third frame 406 shows the exercise apparatus 100 in use to perform a squat exercise. The first cable 118 is connected to one end of the bar 408 by the first connection point 212, while the second cable 120 is connected to an opposite end of the bar 408 by a corresponding connection point of the second set of pulleys 125 associated with the second cable 120 (e.g., configured the same as the first connection point 212 but adapted/positioned for use with the second cable 120). The exercise apparatus 100 is shown as substantially symmetric along a longitudinal centerline or plane of the exercise apparatus 100 (e.g., across the sagittal plane of the user shown in the third frame 406). For the squat exercise shown, the user has the bar 408 resting on the user's shoulders such that the user can exert vertical force on the bar 408 via the user's shoulders (e.g., by pressing the user's torso up with the user's legs). Other positions, grips, etc. are also enabled by the exercise apparatus 100 for various other types and variations of exercises.

In the example shown, the first motor 112 operates to create a tension $T_1$ in the first cable 118 which is experienced at the bar 408 as a force corresponding to double the tension $T_1$, i.e., a force substantially equal to $2*T_1$. The second motor 114 operates to create a tension $T_2$ in the second cable 120, which is experienced at the bar 408 as a force corresponding to double the tension $T_2$, a force substantially equal to $2*T_2$. The total force on the bar 408 by the exercise apparatus 100 in the example of the third frame 406 is therefore approximately $(2*T_1)+(2*T_2)=2*(T_1+T_2)$, i.e., double the tension generated by the first motor 112 plus double the tension generated by the second motor 114. During the second frame 404, a video or other instructional content can play on the screen 140 of the display console 108 guiding (coaching, instructing, encouraging, etc.) the user through the squat exercise. Additionally, the video may stream using an augmented video file that also provides one or more control variables for the first motor 112 and/or the second motor 114, for example directly or indirectly indicating values of $T_1$ and $T_2$ to be applied in the third frame 406.

The direction of the force on the bar 408 by operation of the first motor 112 and the second motor 114 points downwards, in particular towards the first fixed pulley 206 and the second fixed pulley 208 and corresponding pulleys of the second set of pulleys 125 associated with the second cable 120. When performing a squat exercise as shown in the third frame 406, the user exerts an upwards force on the bar 408 in an opposing direction to the force on the bar 408 by the first cable 118 and the second cable 120 (i.e., generated by the first motor 112 and the second motor 114). If the force by the user exceeds double the force generated by the first motor 112 and the second motor 114, the bar 408 moves upwards. If the force by the user is less than double the force generated by the first motor 112 and the second motor 114, the bar 408 (and the user's torso) will move downwards. To perform the squat exercise, the user moves the user's torso up and down by repeatedly exerting various forces on the bar 408.

The first motor 112 and the second motor 114 can be controlled to dynamically vary the force on the bar 408 during a workout, for example between workout sets, between repetitions of an exercise within a set, or during individual repetitions (e.g., to provide a first force in an eccentric phase and a second force in a concentric phase). In some scenarios, the first motor 112 and the second motor 114 operate substantially the same to provide symmetric forces to the bar 408. In other scenarios, the first motor 112 and the second motor 114 may operate asymmetrically to provide an exercise with asymmetric loading on the user (e.g., promoting balance, core engagement, etc.). Various dynamic workouts can be provided with electronic control of the first motor 112 and the second motor 114 which cannot be achieved with conventional weight equipment in which resistance is created by gravitational forces on weighted plates. Such control variation can be selected by a streaming augmented video file as described in further detail below, such that the first motor 112 and the second motor 114 are controlled to dynamically vary the force on the bar 408 in accordance with a streaming video, for example.

In some embodiments, the bar 408 includes one or more inertial measurement units (inertial sensors, accelerometers, gyroscopes, etc.) configured sense movement of the bar 408 (e.g., sensors 810 in FIG. 8, described below). The one or more inertial measurement units can be configured to sense translation and/or rotation of the bar 408 and generate data indicative of a current pose of the bar 408 (e.g., based on detected movement and a known starting positon, for example). The inertial measurement units can be communicable with a controller (e.g., wirelessly) for the first motor 112 and the second motor 114 for use in controlling the first motor 112 and the second motor 114 based on the tracked pose of the bar 408.

In some embodiments, the bar 408 includes a button or other user input enabling a user to initiate or end an exercise by commanding the first motor 112 and the second motor 114 to start or stop providing tension in the first cable 118 and the second cable 120. For example, a button can be mounted on the bar 408 and may be wirelessly (e.g., Bluetooth, WiFi, NFC, ANT+, etc.) communicable with a controller for the first motor 112 and the second motor 114 to allow a user to enter command to start or stop applying force, to increase or decrease force, etc. In some embodiments, the display console 108 receives user inputs (e.g., via a touchscreen or other input device) that allows a user to input commands relating to selecting an exercise or workout, starting or stopping operation of the first motor 112 and the second motor 114, and other functions of the exercise apparatus 100.

Referring now to FIG. 5, a storyboard-style illustration 500 of the exercise apparatus 100 operating to provide a bench press exercise is shown, according to some embodiments. The storyboard-style illustration 500 shows a first frame 502 and a second frame 504 which illustrate a process of providing a bench press exercise. In the example of FIG. 5, the bar 408 is connected to the first cable 118 and the second cable 120 as described with reference to FIG. 4.

In the example of FIG. 5, the exercise apparatus 100 includes a bench 506. The bench 506 is configured to be placed on the base platform 102 and to support a user sitting or lying on the bench 506. For example, the bench 506 may include legs or supports and a padded deck that provides a comfortable lying position for a user. In some embodiments, the bench 506 includes a projection that engages with a recess or other feature of the base platform 102 to enable repeatable, reliable positioning of the bench 506 relative to other elements of the exercise apparatus 100. In some examples, the bench 506 is symmetrically positioned between the first stanchion 104 and the second stanchion 106. To facilitate set-up as in FIG. 5, the display console 108 may be controlled to display instructions (e.g., in video form on screen 140, audio from a speaker, etc.) to a user regarding how to properly position the bench 506 for an upcoming workout (e.g., for the bench press exercise of FIG. 5).

In the first frame 502, the user lies on the bench 506 with arms extended upwards, holding the bar 408 above the user's chest. A force approximately equal to double the tension generated by the first motor 112 plus double the tension generated by the second motor 114 is provided on the bar 408, pointing downwards towards the user's torso. A video can stream on the screen 140 with coaching for the bench press exercise while the first motor 112 and the second motor 114 are controlled based on a control variable included with an augmented video file, in some examples (e.g., a control variable directly or indirectly defining the force to be applied by the motors 112, 114).

Between the first frame 502 and the second frame 504, the force on the bar 408 generated by the first motor 112 and the second motor 114 exceeds an upward force on the bar 408 by the user, such that the bar 408 moves downwards towards the base platform 102, the bench 506, and the user. During such a motion, the first cable 118 is retracted by the first motor 112 and the second cable 120 is retracted by the second motor 114.

To continue to perform the bench press exercise, the user stops motion of the bar 408 proximate the user's chest as shown in the second frame 504 by increasing an upward force on the bar 408 to match the downward force on the bar 408 generated by the first motor 112 and the second motor 114. The user can then increase the user's force on the bar 408 to exceed the force provided on the bar 408 via the first cable 118 and the second cable 120, thereby accelerating the bar 408 upwards and to the position shown in the first frame 502.

To perform multiple repetitions, the exercise apparatus 100 and the user can repeatedly cycle between the first frame 502 and the second frame 504. In some scenarios, the first motor 112 and the second motor 114 operate to provide substantially constant tensions in the first cable 118 and the second cable 120. In some scenarios, the first motor 112 and the second motor 114 are controlled to dynamically adjust the tensions in the first cable 118 and the second cable 120, for example, such that the tension is higher during a first transition phase between the first frame 502 and the second frame 504 compared to during a second transition phase between the second frame 504 and the first frame 502, or vice versa. As another example, the tensions can be increased or decreased between repetitions (e.g., decreasing with each cycle through the first frame 502 and the second frame 504), for example based on a control variable streamed with a workout video.

Referring now to FIG. 6, a storyboard-style illustration operation of the exercise apparatus 100 to provide an arm exercise is shown, according to some embodiments. FIG. 6 shows an exercise involving a single cable (second cable 120 in the example shown) under a force having a one-to-one correspondence with the tension in the second cable 120 generated by the second motor 114. The arrangement of FIG. 6 can be selected by a user to switch from exercises as in FIGS. 4-5 to different types of exercises, such as the one illustrate in FIG. 6.

As shown in FIG. 6, a handle 606 is connected to the second cable 120 via a second connection point 608. The second connection point 608 is located on a distal end of the second cable 120, and can be configured the same as the second connection point 220 associated with the first cable 118 and described above, with the exception of being coupled to the second cable 120. For example, the handle 606 can be coupled to a loop of the second connection point 608 by a carabineer or other type of clip or latch.

To transition from the example of FIG. 5 to the example of FIG. 6, the user can detach the bar 408 from the first connection point 212 and a corresponding first connection point associated with the second cable 120, set the bar 408 aside, obtain the handle 606, and connect the handle 606 to the second connection point 608. Through such a process, the exercise apparatus 100 is reconfigured from providing an exercise subject to double the tensions generated by the first motor 112 and the second motor 114 to an exercise subject to a force corresponding to the tension generated by one of the motors (i.e., by the second motor 114 in the example of FIG. 6) without the force multiplication effect described above with reference to FIGS. 3-5. Instructions can be displayed on the screen 140 of the display console 108 guiding the user through steps of disconnecting the bar 408 and connected the handle 606. For example, a video may be played on the screen 140 in which an instructor provides visual and/or audio (e.g., emitted by a speaker of the display console 108). The first motor 112 and/or the second motor 114 can also be controlled to facilitate the transition (e.g., removing a force to enable easy manipulation of the cable during disconnection/connection, gently retracting any slack in the cable, etc.), for example in accordance with control information from a streaming video file.

Still referring to FIG. 6, the first frame 602 shows the user beginning to exert a force on the handle 606 pulling the handle 606 away from the second terminal 124, thereby pulling the second cable 120 through the second terminal 124. The second motor 114 resists this pulling/extraction motion, as the user exceeds the force provided by the second motor 114 to transition from the first frame 602 to the second frame 604. Instructions can be displayed on the screen 140 of the display console 108 guiding the user through the exercise (e.g., in the form of a video of an instructor providing instructions and/or demonstrating the exercise), while the second motor 114 may be controlled based on settings streamed with the video.

As shown in the second frame 604, the user has pulled the handle 606 away from the second terminal 124, resisted by the tension in the second cable 120 (i.e., by a force pointing toward the second terminal 124). The length of the second cable 120 between the handle 606 and the second motor 114 has increased accordingly between the first frame 602 and the second frame 604. The user can then reduce the force exerted by the user on the handle 606 to allow operation of the second motor 114 to pull the handle 606 back toward the second terminal 124 as the second motor 114 retracts the second cable 120. The exercise apparatus 100 thus provides for repeated cycling through the first frame 602 and the second frame 604 to allow performance of an exercise.

Various exercise can be enabled by the arrangement shown in FIG. 6, including by attaching different types of handles that can be included with the exercise apparatus 100 and by adjusting the position of the second terminal 124 along the second stanchion 106. In some scenarios, a separate handle is also connected to the second connection point 220 coupled to the first cable 118, such that an exercise can be performed by simultaneous experiencing decoupled forces generated by the first motor 112 and the second motor 114. Various such examples can be performed in various embodiments.

In some embodiments, the exercise apparatus 100 includes one or more sensors or detectors configured to provide data indicative of where the user selected to attach an exercise implement (e.g., bar 408, handle 606) to the first cable 118 and/or the second cable 120, e.g., at a first connection point 212 or a second connection point 220, for example. In some such embodiments, the exercise apparatus 100 includes a sensor configured to determine if the moveable pulley is in the default/bottom position (i.e., as shown in FIG. 2, between/below the first fixed pulley 206 and the second fixed pulley 208. For example, the sensor may be a proximity sensor, a physical switch sensor, or a through beam sensor. If a user has connected to and is using the first connection point 212, such a sensor can detect that the first connection point 212 has moved from its default position and is therefore in use. If the first connection point 212 is detected as being at the default position, the sensor data indicates that the second connection point 220 is being used for an exercise. Such data (e.g., sensor output) can be provided to a controller and used to control the first motor 112 and/or the second motor 114. In other embodiments, the user may input an indication of which connection was selected via a touchscreen, keypad, or other input device of the display console 108 or via a remote control device. For example, a user may select between various exercise (e.g., squat, bench press, row, etc.) which are associated with different motor controls and different connection points, causing the first motor 112 and the second motor 114 to be controlled to provide suitable behavior of the exercise apparatus 100 for the selected exercises. In other scenarios, the exercise apparatus 100 can stream an augmented video file which both provides instructions to a user for switching between various exercises and settings executed by the exercise apparatus 100 for automatically reconfiguring and/or facilitating reconfiguration of the exercise apparatus and applying appropriate forces for an instructed exercise. Various other motor control strategies, preprogrammed workouts, user customizations, digital interactivity, etc. can be provided by or via the exercise apparatus 100.

Figure 7:
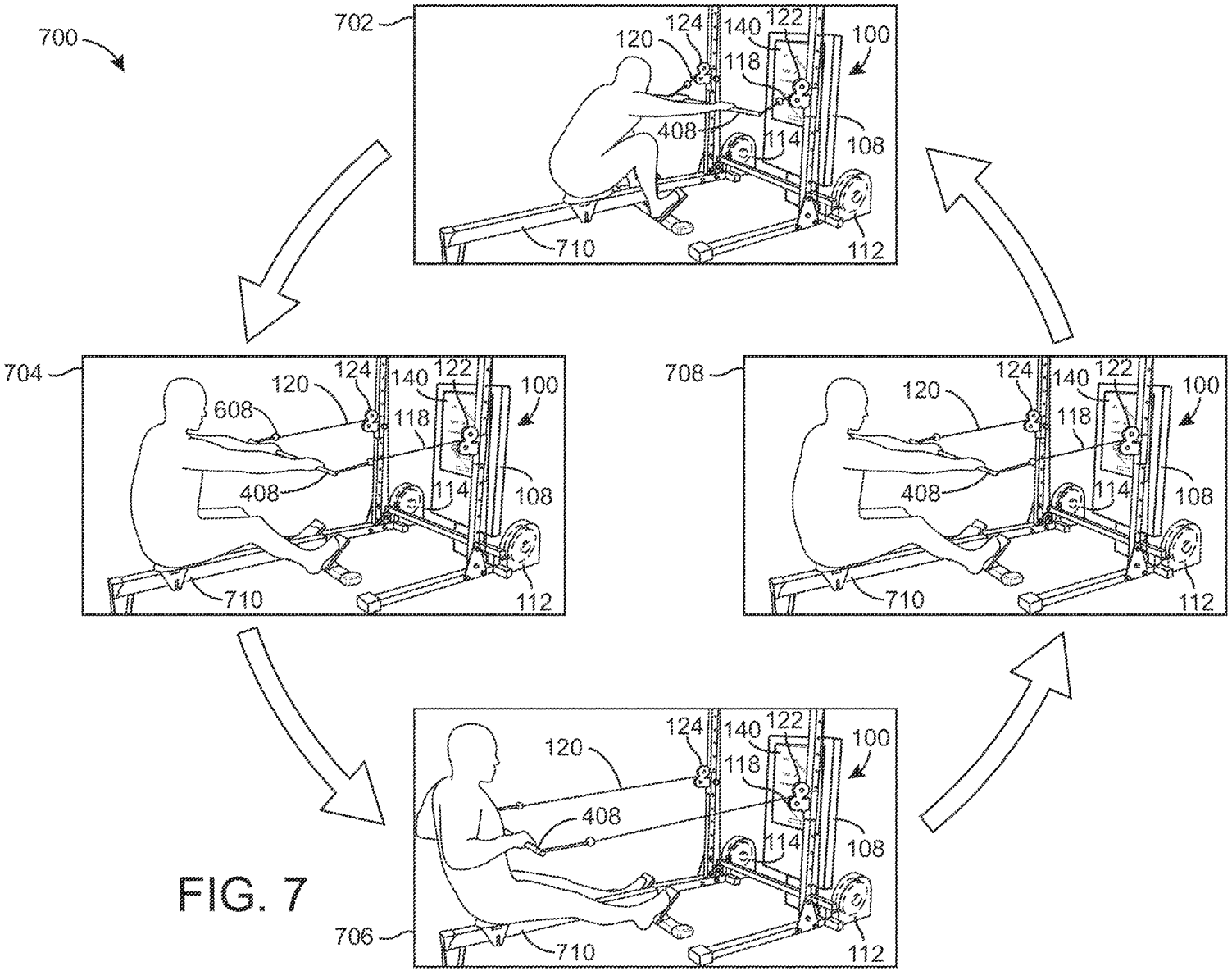
FIG. 7 is a storyboard-style illustration of operation of the exercise apparatus of FIG. 1 to provide a rowing simulation, according to some embodiments.

Referring now to FIG. 7, an illustration 700 of operation of the exercise apparatus 100 to provide a rowing simulation exercise with a user performing a rowing stroke is shown, according to an exemplary embodiment. The illustration 700 shows a cycle through a first phase 702, a second phase 704, a third phase 706, and a fourth phase 708 of the rowing stroke. The exercise apparatus 100 is configured to provide an exercise for a user as the user repeatedly cycles through the phases shown in FIG. 7.

As shown in FIG. 7, the exercise apparatus 100 has been reconfigured (e.g., by the user) so that the bar 408 is attached to the second cable 120 at the second connection point 608 and similarly connected to the first cable 118. The bar 408 is attached to the first cable 118 and the second cable 120 such that bar 408 is pulled toward the terminals 122, 124 by tension in the first cable 118 and the second cable 120. The exercise apparatus 100 has also be arranged so that a bench 710 is positioned to support the user during performance of a rowing exercise. The bench 710 is shown to have a sliding seat and a set of footholds that enable a user to slide along the bench 710 during the rowing stroke as described below. The bench 710 may be a different bench than the bench 506 of FIG. 5 or may be the same bench as used in FIG. 5 in an embodiment where the bench is convertible between a static state (suitable for a bench press exercise as in FIG. 5) and a sliding, dynamic state (suitable for a rowing exercise). Instructions may play on the display screen 140 of the display console 108 to guide the user through configuring the exercise apparatus 100 into the arrangement shown in FIG. 7. In some embodiments, the terminals 122, 124 are coupled to actuators and automatically repositioned by such actuators to reach a suitable position for a rowing exercise (e.g., in accordance with a control signal from an augmented video file as described below).

In the first phase 702, the user is in the catch phase of a rowing stroke. An exercise can be initiated from the first phase 702. At the first phase 702, a controller (e.g., control circuitry 806 discussed below) can operate to control the first motor 112 and the second motor 114 to start providing a first tension in the first cable 118 and the second cable 120. The first cable 118 and the second cable 120 are largely retracted by the first motor 112 and the second motor 114 at the first phase 702, for example so that the bar 408 can be held proximate the terminals 122, 124 without slack in the cables 118, 120. The screen 140 can display a video showing instructions for performing the rowing stroke, among other data, guidance, cadence information, power information, etc.

In the second phase 704, the user is in the power (propulsion) phase of a rowing stroke. The user extends the user's legs and pulls on the bar 408 with the user's hands to move through the second phase 704. During the second phase 704, the first motor 112 and the second motor 114 are controlled to generate torque to resist the user's force on the bar, e.g., to resist the unspooling of the first cable 118 and the second cable 120. The first motor 112 and the second motor 114 thus provide a controllable amounts of tension in the first cable 118 and the second cable 120, which can be dynamically controlled and independently varied depending, for example, on a workout plan for the user and/or based on control variables streamed with a workout video.

For example, in some scenarios equal tension is generated in both cables 118, 120, thus providing an even/balanced force to the user. In other scenarios an uneven tension is generated (i.e., a higher or lower tension in the first cable 118 compared to the second cable 120) to cause asymmetric loading of the user which can cause activation of additional muscles for the user. The control circuitry can vary the tension in the first cable 118 and the second cable 120 according to user settings, in order to follow a pre-defined workout routine, in order to cause the user to achieve a target speed or acceleration of the bar 408, etc., during the second phase 704.

At the third phase 706, the user is at the finish phase of the rowing stroke, where an oar blade would exit the water in an actual rowing scenario. At the third phase 706, the user stops pulling the bar 408 away from the terminals 122, 124 and exerts zero or low force on the bar 408 in the direction away from the terminals 122, 124. The first motor 112 and the second motor 114 are configured to detect the change in movement of the cable associated with occurrence of the third phase 706, and to provide an indication of the occurrence of the third phase 706 to control circuitry In response, the first motor 112 and the second motor 114 can be controlled to transition from generating tensions suitable for the second phase 704 (power phase) to generating tensions suitable for the fourth phase 708 (recovery phase) of the rowing stroke.

At the fourth phase 708 (the recovery phase), the user moves the bar 408 back toward the terminals 122, 124. The first motor 112 and the second motor 114 operate to retract the first cable 118 and the second cable 120 while providing a non-zero tension in the first cable 118 and the second cable 120. The first cable 118 and the second cable 120 are thereby retracted with approximately the same speed that the user moves the bar 408 toward the terminals 122, 124.

Advantageously, the tension provided during the fourth phase 708 is dynamically adjustable by operation of the motors 112, 114. For example, in some embodiments a relatively low tension is provided to gently retracted the first cable 118 and the second cable 120 while allowing a user to easily move back to the first phase 702. In other scenarios, a higher tension is provided to forcefully pull the bar 408 toward the terminals 122, 124, such that a user is compelled to resist the movement of the bar 408 via an eccentric exercise. An eccentric exercise can thus be dynamically added or removed from the paddling stroke of illustration 700 as desired, for example according to user inputs (e.g., voice commands), predefined workout plans, interactions with a virtual environment, control variables of an augmented video file, etc. As for the second phase 704, the tensions provided in the third phase can be equal (symmetric) or unequal (asymmetric) to provide various workouts to the user.

Following the fourth phase 708, the rowing stroke of illustration 700 returns to the first phase 702 (the catch phase), at which the user stops the movement of the bar 408 toward the terminals 122, 124 and starts motion of the bar 408 away from the terminals 122, 124. The first motor 112 and the second motor 114 are configured to detect occurrence of the first phase 702 and provide an indication of occurrence of the first phase 702 to control circuitry. The control circuitry can then transition operation of the first motor 112 and the second motor 114 from providing the tension used in the fourth phase 708 (recovery phase) to the tension used in the third phase 706, thus restarting the cycle through the phases of the rowing stroke shown in the illustration 700 of FIG. 7. FIG. 7 thereby illustrates that the exercise apparatus 100 can operate to provide a rowing-type paddling workout. Other paddling simulations (kayaking, canoeing, stand-up paddle boarding, etc.) are also able to be provided by the exercise apparatus 100. Taking FIGS. 4-7 together, the exercise apparatus 100 enables a wide variety of strength-training and endurance exercises that can be performed individually or together in a workout, for example in accordance with a workout video streamed by the exercise apparatus 100 and played on the screen 140.

Figure 8:
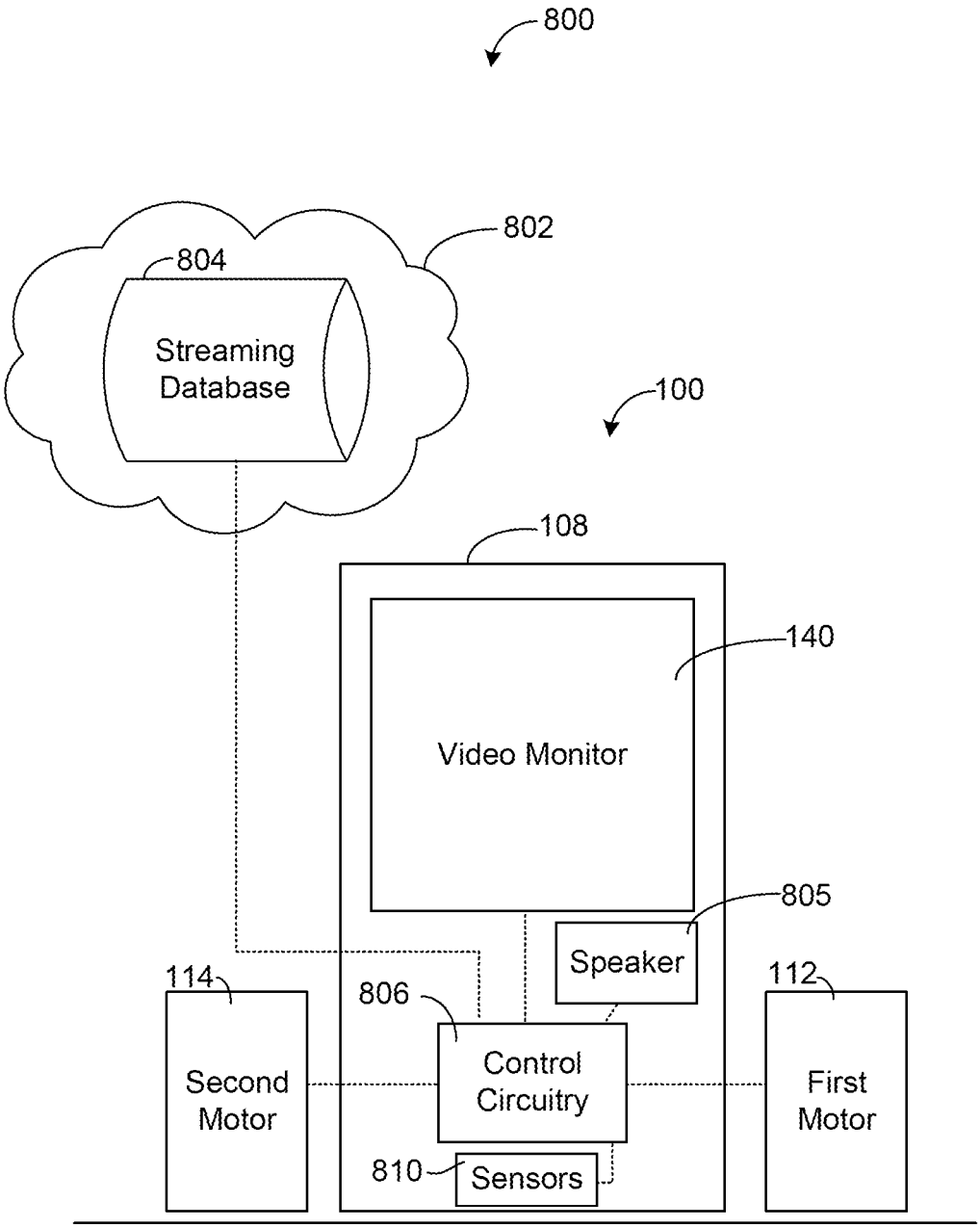
FIG. 8 is a block diagram of a system including the exercise apparatus that enables streaming of augmented video files, according to some embodiments.

Referring now to FIG. 8, a block diagram of a system 800 including the exercise apparatus 100 is shown, according to some embodiments. The system 800 includes the exercise apparatus 100 and a remote computing resource (e.g., cloud-based computing resource) 802 which includes (hosts, stores, provides, etc.) a streaming database 804. The remote computing resource 802 may also include other programs or databases, for example storing user account information or storing and processing user performance data.

The exercise apparatus 100 is shown as including the first motor 112, the second motor 114, the display console 108 with screen 140 and a speaker 805, control circuitry 806, and sensors 810. The control circuitry 806 and the sensors 810 are shown as being positioned at or in the display console 108, but may be positioned elsewhere in the apparatus 100 in various embodiments (e.g., in base 102, at the first motor 112, at the second motor 114). The control circuitry 806 is communicable with (e.g., conductively coupled to, wired to, wirelessly communicable with), the first motor 112, the second motor 114, the video monitor (screen) 140, the speaker 805, and the sensors 810. The control circuitry 806 is also communicable with the streaming database 804 at the remote computing resource 802, for example via one or more networks (Internet, intranet, Ethernet, WiFi, etc.).

Figure 9:
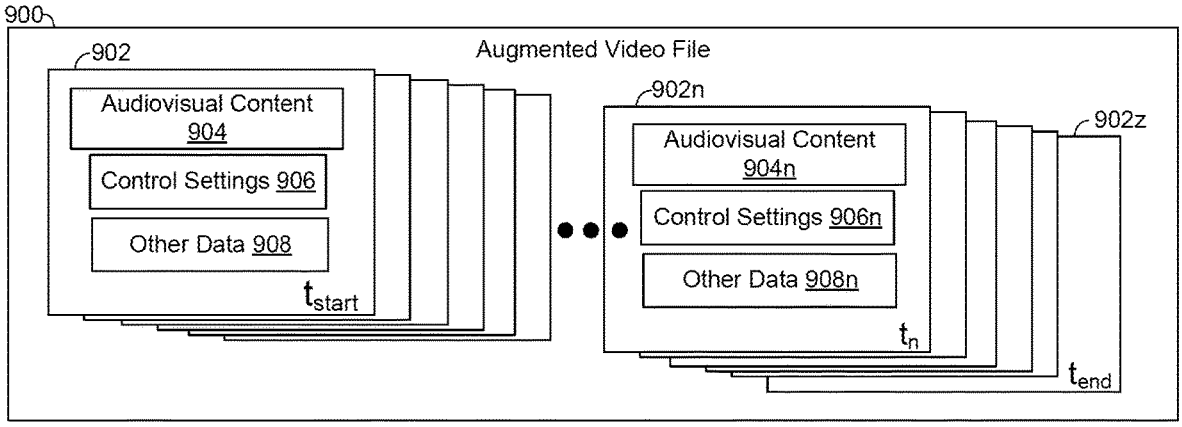
FIG. 9 is a schematic illustration of an augmented video file, according to some embodiments.

The streaming database 804 stores (is configured to store, includes, etc.) a set of augmented video files (e.g., as shown in FIG. 9 and described in detail with reference thereto) and to stream the augmented video files to the control circuitry 806 on demand. The streaming database 804 may host a menu, list, selection portal, etc. configured to identify the available augmented video files to the control circuitry 806 to facilitate selection of an augmented video file from the set for on-demand streaming. The streaming database 804 may host a webserver that facilitates connection between the streaming database 804 and the control circuitry 806, for example via the Internet using a hypertext transfer protocol (HTTP). In alternative embodiments, the streaming database 804 is a storage drive (hard drive, solid state drive, disc drive and suitable media, etc.) provided locally at the exercise apparatus 100 (e.g., physically coupled to the control circuitry 806, positioned in the display console 108).

The control circuitry 806 is configured to control the first motor 112, the second motor 114, the video monitor 140, and the speaker 805. For example, the control circuitry 806 can control an amount of force provided by the first motor 112 to the first cable 118 (e.g., by affecting a voltage across the first motor 112 or a current to the first motor 112, for example), and an amount of force provided by the second motor 114 to the second cable 120 (e.g., by affecting a voltage across the first motor 112 or a current to the first motor 112, for example). In some embodiments, the control circuitry 806 implements feedback control loops configured to drive a force produced by the first motor 112 to a first target force and a force produced by the second motor 114 to a second target force. The control circuitry 806 can use measurements, data, etc. from the sensors 810 as inputs to control logic for controlling the first motor 112 and the second motor 114.

The control circuitry 806 is also configured to control the video monitor 140, i.e., to cause the video monitor 140 to display visual content (images, video, etc.). The control circuitry 806 is further configured to cause the speaker 805 to emit sounds, for example to play an audio track of a video file. In the embodiment shown in FIG. 8, the speaker 805 is integrated into the display console 108 and operates to emit sound from the display console 108. As an additional or alternative audio feature, an external audio device (e.g., wireless headphones, wireless earbuds) can be wirelessly communicable with the control circuitry 806 (e.g., via Bluetooth) and the control circuitry 806 can configured to cause the external audio device to emit sound, for example to play an audio track of a video file.

The sensors 810 can measure various conditions and parameters relating to operation and use of the exercise apparatus 100 and/or actions of a user thereof, in various embodiments. For example, the sensors 810 may include force sensors (load cell, strain gauge, etc.) configured to measure the force output of the first motor 112 and the second motor 114, for example for use in a feedback control loop for control of the first motor 112 and the second motor 114. As another example, the sensors 810 may include one or more inertial measurement units (inertial sensors, accelerometers, gyroscopes, etc.) configured sense movement of the bar 408 or other element of the exercise apparatus 100. As another example, the sensors 810 can include one or more weight sensors (e.g., load cells) in the base 102 that sense weight of the user and/or the bench on the base 102 (including, in some scenarios, additional forces on the user from the first motor 112 and/or second motor 114) which may be indicative of user performance. As another example, the sensors 810 can include a heart rate monitor or other wearable measuring device of a user and wirelessly communicable (e.g., via Bluetooth, ANT+) with the control circuitry 806. As another example, sensors 810 can include input devices (buttons, touchscreen elements, knobs, switches, microphone, etc.) to receive commands from a user to the exercise apparatus 100. These and or various other sensors configured to collect operating data of the exercise apparatus 100 and/or performance data of a user can be included in various embodiments.

The control circuitry 806 is configured to request augmented video files from the streaming database 804, for example by transmitting requests from the control circuitry 806 to the streaming database 804 via a network (e.g., over the Internet). In some scenarios, the control circuitry 806 causes the video monitor 140 to display a list of available workout videos to a user and enables the user to select a particular workout video from the list (e.g., via the video monitor 140 in an embodiment where the video monitor 140 is a touchscreen, via another input device to the user interface, etc.). The control circuitry 806 then sends a request to the streaming database 804 for that particular workout video to be streamed to the control circuitry 806 from the streaming database 804.

The control circuitry 806 then receives an augmented video file corresponding to the requested workout video from the streaming database 804. In some embodiments, the control circuitry 806 downloads the entire augmented video file first, before proceeding with use of the augmented video file. In other embodiments, the control circuitry 806 uses the augmented video file as described above while the data streams over time from the streaming database 804 to the control circuitry 806. Various data streaming techniques for improving quality, eliminating buffering, providing data security, etc. can be executed by the control circuitry 806, the streaming database 804, and/or other networked components to facilitate smooth, consistent, reliable streaming of augmented video files.

The control circuitry 806 is configured to use the augmented video file (e.g., as shown in FIG. 9 described in detail below) to control the first motor 112, the second motor 114, the video monitor 140, and the speaker 805, for example by executing process 1000 of FIG. 10 described in detail below. The control circuitry 806 may also collect performance data and upload such data back to the remote computing resource 802, for example by executing process 1100 of FIG. 11 described in detail below.

Referring now to FIG. 9, an schematic illustration of an augmented video file 900 is shown, according to some embodiments. The augmented video file 900 shows an example data structure for the augmented video file 900. The augmented video file 900 can be stored by the streaming database 804 and streamed to the control circuitry 806 on demand.

As shown in FIG. 9, the augmented video file 900 includes data that spans a runtime of a workout video from time $t_{start}$ to time $t_{end}$ (with intermediate times $t_n$). The timespan from time $t_{start}$ to time $t_{end}$ is the runtime (duration) of the workout video of the augmented video file 900. FIG. 9 illustrates that the augmented video file 900 includes data packets (shown as first data packet 902 continuing through nth data packet 902*n* up to final data packet 902*z*) for time steps or periods within the runtime of the video. Each data packet 902, 902*n*, 902*z* stores data to be used by the control circuitry 908 during the corresponding time step or period within the runtime of the video.

As shown in FIG. 9, the first data packet 902 includes audiovisual content 904, control settings 906, and other data 908 all associated with time step $t_{start}$. The audiovisual content 904 includes data of an audio track usable to control the speaker 805 to emit sounds of the workout video, for example recorded vocalizations of an instructor, music, background sounds, etc. The audiovisual content 904 also includes data of a video track (e.g., a series of images, data for illumination of pixels of a screen) usable to control the video monitor 140 to display the visual elements of the workout video. The augmented video file 900 thereby provides the control circuitry 806 with data usable by the control circuitry 806 to control the speaker 805 and the video monitor 140.

The control settings 906 include values of one or more control variables relating to operation of the first motor and the second motor. For example, the control settings 906 can include a force setpoint indicating an amount of force to be generated by the first motor 112 and/or the second motor 114 at or during time $t_{start}$ (e.g., a target total force for both motors 112, 114, separate targets for the first motor 112 and the second motor 114). As another example, the control settings 906 can include a normalized control value that is used to calculate an amount of force to be generated by the first motor 112 and/or the second motor 114 at or during time $t_{start}$ (e.g., a target total force for both motors 112, 114, separate targets for the first motor 112 and the second motor 114), for example as a function of a user-specific scaling factor. One such examples is a control variable indicating a percentage value which the control circuitry 806 can multiply by a one-rep maximum force of a user (or other indication of a user's fitness level) to obtain a target force for the first motor 112 and/or the second motor 114.

In some embodiments, the control settings 906 include an indicator selecting control logic or a control algorithm from a set of possible control logic or algorithms. For example, the control settings 906 may indicate whether forces provided by the first motor 112 and/or the second motor 114 should be static during time $t_{start}$ or dynamic during time $t_{start}$, and, if dynamic, how such forces should vary (e.g., vary over repetitions, vary between eccentric and concentric phases). As another example, the control settings 906 may indicate the type of workout to be performed during time $t_{start}$, for example indicative of control differences that may facilitate strength training exercises (e.g., as in FIGS. 4-6) relative to endurance exercises (e.g., as in FIG. 7).

In some embodiments, the control settings 906 include values of a control variable that facilitates and/or partially automate reconfiguration of the exercise apparatus to a desired configuration or an exercise to be performed at time $t_{start}$. For example, the control variable may indicate that the first motor 112 and the second motor 114 should be controlled to relax tension in the first cable 118 and the second cable 120 to facilitate connection and disconnection of the first cable 118 and second cable 120 from the bar 406 or handle 606, allow movement of the bar 406 to start points for different exercises, etc. As another example, in embodiments where the terminals 122, 124 are coupled to controllable actuators, the control settings 906 can include target positions for the terminals 122 and 124 used by the control circuitry 806 to control such actuators to automatically reposition the terminals 122 and 124.

The data packet 902 is also shown as including other data 908. Various types of data that may be useful to encode in the augmented video file 900 can be included in various embodiments. As one example, the other data 908 may include indications to start or stop collection and binning of user performance data, for example as described below with reference to FIG. 11. As another example, the other data 908 can include subtitles (closed captioning, translations, etc.) that can be selectively displayed over the video track on the video monitor 140. As another example, the other data 908 can include information for controlling interface features of the display console 108 other than the video monitor 140, for example indicator lights and/or a pacing lighting system as described in U.S. application Ser. No. 17/010,573, filed Sep. 2, 2020, the entire disclosure of which is incorporated by reference herein.

The augmented video file 900 is made up of a sequence of data packets 902, . . . , 902*n*, . . . 902*z*, each of which includes audiovisual content (e.g., audiovisual content 904*n*), control settings (e.g., control settings 906*n*), and other data (e.g., other data 908*n*) such that each time step or period (e.g., time $t_n$) is associated with corresponding audiovisual content, control settings and, in some embodiments, other data. The control settings for a given time step or period are thus aligned with, in sync with, and correspond to the audiovisual content for that time step or period. There augmented video file 900 thereby delivers integrated content that can be used by the control circuitry 806 to automatically adjust control of the first motor 112 and the second motor 114 in accordance with instructions, coaching, etc. presented in the audiovisual content. The augmented video file 900 can thus reduce or eliminate demands on a user to select appropriate settings and configurations between exercises in a workout video.

In some embodiments, the augmented video files (e.g., augmented video file 900) stored by the streaming database 804 are designed for distribution to any number of users and are agnostic to the particular user of the exercise apparatus 100 at any given time. For example, a fitness personality, celebrity, professional athlete, etc. may record a workout video and the augmented video files 900 are made available to a large number of users of exercise apparatus 100 and/or other instances of the exercise apparatus 100 that can be used across a wide range of geographic locations. In other examples, augmented video files can be customized for particular users. For example, a user (or a coach, trainer, etc.) may be provided with an interface (e.g., internet browser interface, mobile application, etc.) that allows the user to select a series of exercises, numbers of reps, numbers of sets, etc. to build a custom workout for that user. A custom workout file is then created which can be streamed so that settings of the exercise apparatus 100 are automatically updated as the workout progresses as described herein. In some such embodiments, pre-created video clips are combined based on the selected series of exercises to building a custom video which plays, such that a custom augmented video file 900 is provided. In other examples, the custom workout file is provided with still images or instructions in place of streaming video, while still operating substantially as described herein for the augmented video file 900. Custom workout files can be stored in the streaming database 804 and accessed on demand via the control circuitry 806.

Figure 10:
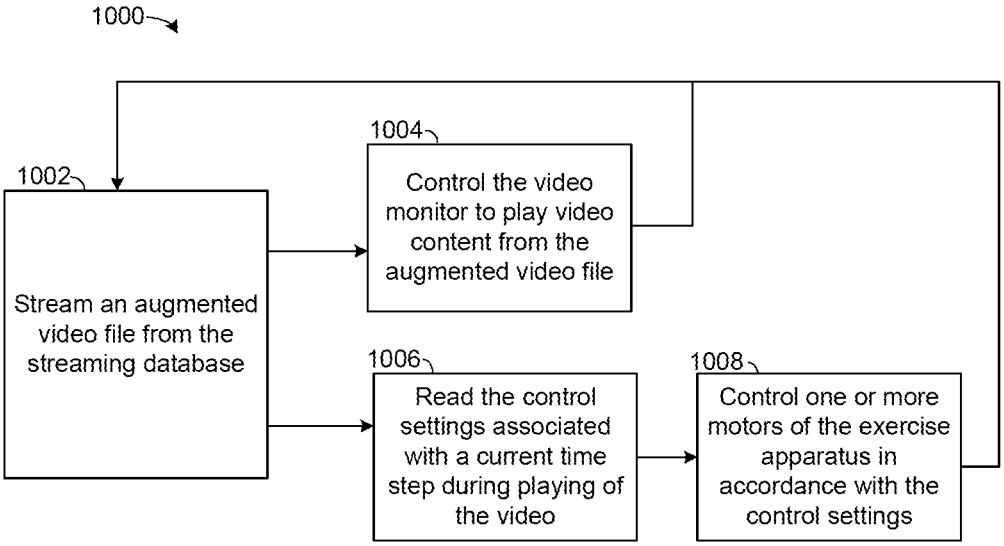
FIG. 10 is a flowchart of a process executed by the exercise apparatus using the augmented video file, according to some embodiments.

Referring now to FIG. 10, a flowchart of a process 1000 is shown, according to some embodiments. The control circuitry 806 is configured to execute the process 1000 in some embodiments.

At step 1002, an augmented video file is streamed from the streaming database 804 to the control circuitry 806. Step 1002 can include receiving the video at a network interface of the control circuitry 806 for example via a WiFi or Ethernet connection. Data packets 902 can be received over the network at the control circuitry 806 over time during runtime of the video, such that an augmented video files streams substantially continuously from the streaming database 804 to the control circuitry 806 as a remainder of process 1000 is executed. As shown in FIG. 10, process 1000 repeatedly loops through step 1002 such that the augmented video file continues to be streamed to the control circuitry 806.

At step 1004, the video monitor 140 is controlled to play video content from the augmented video file. Step 1004 may also include controlling the speaker 805 to play audio from the augmented video file. The control circuitry 806 can use the audiovisual content 904 to control the video monitor 140 and the speaker 805 at step 1004. A workout video can thereby be displayed by the exercise apparatus 100.

At step 1006, control settings associated with a current time step during playing of the workout video are read by the control circuitry 806. Step 1006 can be executed in parallel with step 1004 as illustrated in FIG. 10, for example such that control settings 906 and audiovisual content 904 from the same data packet 902 are read and processed in parallel to sync the control settings 906 with the audiovisual content 904. For example, at any given time $t_n$ during a runtime of the workout video, the control settings 906*n* are used in step 1006 in parallel with use of audiovisual content 904*n*, both from the data packet 902*n* corresponding to time $t_n$.

At step 1008, the motors of the exercise apparatus are controlled in accordance with the control settings. Step 1008 can include various processing steps to determine control outputs or values for the motors based on the control settings read in step 1006. For example, step 1008 can include calculating a target force for one or more both of the first motor 112 and the second motor 114 based on a value of a control variable of the control settings and a user-specific scaling factor indicative of some aspect of the user's fitness level. As one such example, the user-specific scaling factor may be a user-selected subjective fitness or effort level (e.g., easy, moderate, hard; beginner, intermediate, expert), and step 1008 can include using a function or look-up table that maps such user-selected levels to particular target force values based on different values of the control variable. As another such example, the user-specific scaling factor can be based on user performance data, for example a user's one-rep maximum force for an exercise (e.g., based on user inputs, based on collected data of the user's past performance), and the control value can be percentage (e.g., fraction, value between zero and one) that is multiplied by the user performance data to obtain a target force.

In some examples, step 1008 can include initiating a control algorithm that provides dynamic force targets for control of one or both of the first motor 112 and the second motor 114 based on the control settings. For example, the control settings may indicate that the force should vary dynamically between phases of an exercise, across repetitions of an exercise, or to deliberately introduce perturbations or asymmetric dynamic loading to a user during an exercise. Step 1008 can include executing control loops based on such settings, including based on readings from sensors 810, in order to provide any such control indicated by the control settings streamed in an augmented video file at step 1002. Step 1008 can include assigning controlling the first motor 112 to provide different forces than the second motor 114 if so indicated by the control settings.

Step 1008 thereby results in the first motor 112 and the second motor 114 being controlled in accordance control settings streamed at step 1102, and in particular with control settings corresponding to audiovisual content displayed in parallel with control of the first motor 112 and the second motor 114. Control of the first motor 112 and the second motor 114 is thereby synced with instructions, coaching, etc. in a workout video displayed by the exercise apparatus 100. Steps 1002, 1004, 1106, and 1008 can be executed repeatedly and substantially continuously throughout a runtime of a workout video to provide a complete and seamless experience that can transition between different types of exercises, different forces on the user, different configurations of the exercise apparatus, etc., for example as shown in FIGS. 4-7, without requiring the user to manually adjust control settings for the first motor 112 and the second motor 114. Process 1000 and the other features herein thereby provide a seamless, immersive user experience.

Figure 11:
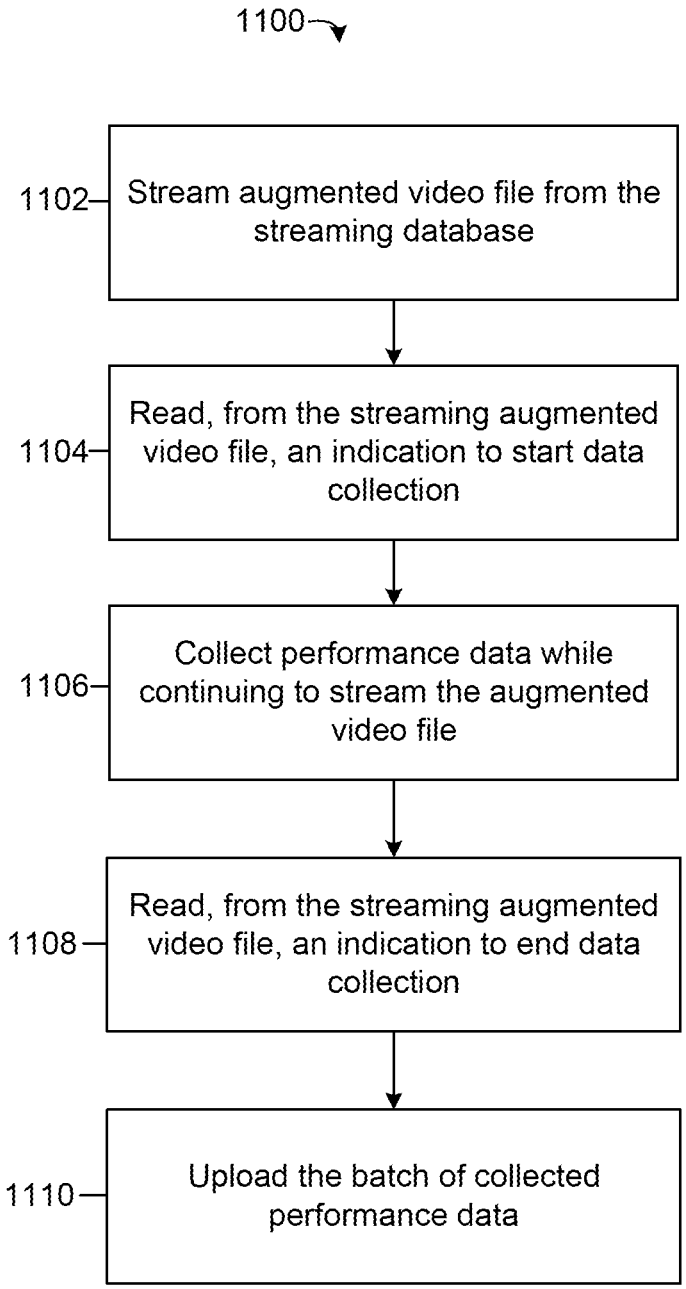
FIG. 11 is a flowchart of a process of data collection and batching by the exercise apparatus involving the augmented video file, according to some embodiments.

Referring now to FIG. 11, a process 1100 for efficient collection and upload of user performance data is shown, according to some embodiments. Process 1100 can be executed by the control circuitry 806 in parallel with process 1000, for example. Process 1102 generally enables sharing of user performance data to the remote computing resource 802 (e.g., to a user account stored thereon) in batches which reduce network demands and enable metrics or other analyses across subparts of a workout.

At step 1102, an augmented video file is streamed from the streaming database to the control circuitry 806. Step 1102 can be the same as step 1002, for example.

At step 1104, an indication to start data collection can be read from the augmented video file. The indication to start data collection can be included in other data 908*n* of the augmented video file 900 of FIG. 9, for example. The indication can thereby be time-aligned with particular audiovisual content (e.g., particular instructions to start an exercise presented in a workout video) and corresponding control settings for the first motor 112 and the second motor 114. Process 1104 thereby enables selective initiation of data collection synced with a streaming workout video. As one example, the augmented video file can place the indication to start data collection after an introductory or warm-up portion of a workout so that data collection starts at a portion of the workout of particular interest. This can advantageously reduce the amount of collected data, for example.

At step 1106, performance data is collected, in response to the indication read at step 1104, while the augmented video file continues to stream. Step 1106 can correspond to a time period during which a user performs an exercise of interest. The performance data can include the amount of force moved by the user, a number of repetitions or sets of the exercise completed by the user, an average power output of the user, a user's heart rate, speed, distance, etc. as may be suitable for different strength training and endurance exercises. The performance data can be collected by the sensors 810, received from a wearable device of the user (e.g., heart rate monitor), or obtained based on control settings for the first motor 112 and the second motor 114, for example. Step 1106 includes collecting such data and saving such data in memory (e.g., RAM) locally at the control circuitry 806. In some embodiments, data collection starts automatically upon reading of the indication at step 1104. In other embodiments, data collection starts in response to a combination of reading the indication to start data collection and an action of a user, for example a press of a button, a vocal command, or a movement of the user associated with the user starting to perform an exercise (e.g., determined based on data from sensors 810).

At step 1108, an indication to end data collection is read from the augmented video file. The indication to end data collection can be included in other data of data packet 900*z* of the augmented video file 900 for example (i.e., any data packet that which is read at step 1004). The indication to end data collection is read by the control circuitry 806 at step 1108, in response to which the control circuitry 806 ends data collection. Alternatively, the indication to end data collection is provided as a data collection duration indicated in an earlier data packet (e.g., with the indication to start data collection), and data collection is ended after the duration elapses. For example, the indication to end data collection can correspond to an end of an active section of a workout (e.g., before a cool down or conclusion section of a video), a transition between exercises (e.g., after a rowing exercise and before a squatting exercise), an end of set of repetitions of an exercise (e.g., at a beginning of a rest period), etc. Data collection can thus be automatically ended in response to step 1108. Automatically defining the time period for data collection in alignment with instructions in a workout video can avoid collecting empty data for periods in which a user is not being instructed to perform an exercise (e.g., during rest periods, during set-up or transition periods, during a cool-down period) which reduces data storage requirements. Constraining data collection to active periods can also provide more interesting and insightful data by avoiding distortions otherwise introduced by such periods: for example, including non-active introductory, cool-down, recovery, etc. periods of data can drive down performance averages (heart rate, power, etc.) in a manner that distorts the user's actual intensity during active portions of a workout, such that the data collected in step 1106 (bounded by steps 1104 and 1108). As another example, bounding data collection between steps 1104 and 1108 can limit data collection to a particular exercise, which can be advantageous in workouts with the exercise apparatus 100 that include diverse types of exercises having different relevant performance data.

At step 1110, the collected performance data is uploaded as a batch to the remote computing resource 802, for example a user accounts database hosted thereon. Step 1110 can include organizing the data collected in step 1106 between the indication to start data collection and the indication to end data collection as a batch of data. In some embodiments, step 1110 includes compressing the batch of collected performance data to reduce network requirements for upload. Step 1110 can include waiting for a period of network availability before uploading the batch of collected data, for example uploading the batch of collected data after an end of streaming of the augmented video file to the control circuitry 806. Step 1110 can also include erasing the collected data from the control circuitry 806 after upload to the remote computing resource 802, in some embodiments.

The collected performance data can be used in various ways. In some embodiments, the collected performance data is used to train user-specific scaling factors which are then used to determine force targets for different exercises for a specific user based on that user's historical performance. The batched performance data could also be used for competitions between different users. In some examples, the batched performance data is processed and presented to a user on a dashboard, shared to social media, etc. As one such example, comparisons across users can be presented (e.g., leader board, head-to-head competition scoring, etc.) on a per-exercise basis. Such comparisons can be facilitated by the exercise identifier tagged on the batch of performance data, as described below with reference to FIG. 12, for example. Various advanced sharing and analytics features can thus be enabled by process 1100.

Figure 12:
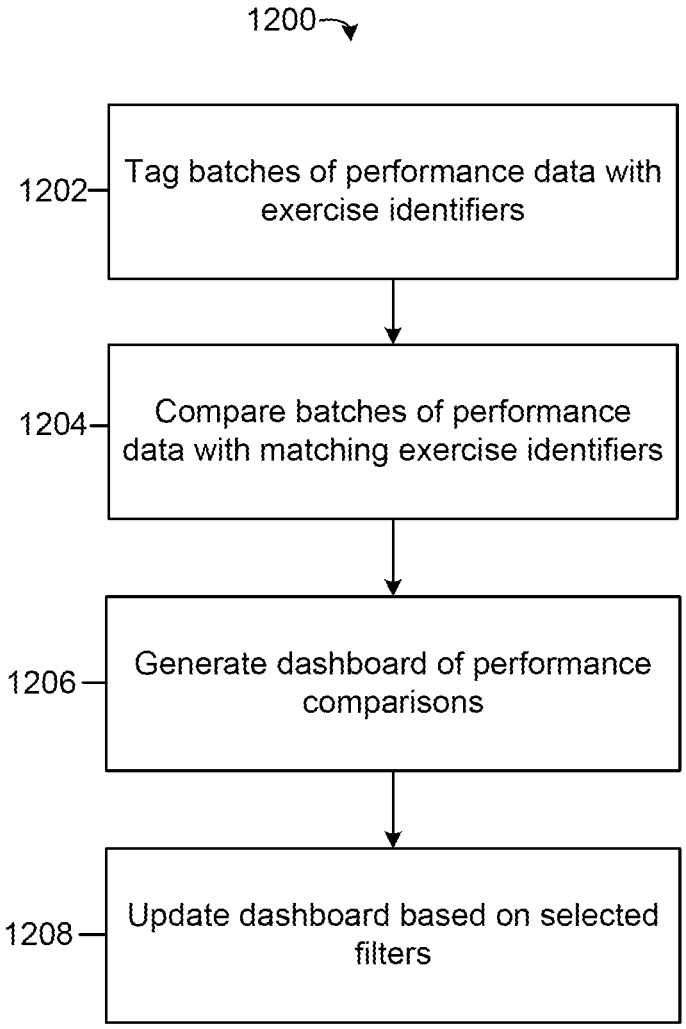
FIG. 12 is a flowchart of a process of handling performance data, according to some embodiments.

Referring now to FIG. 12, a process 1200 for handling performance data, for example batches of performance data output from process 1100 is shown, according to some embodiments. Process 1200 can be executed by system 800, for example by remote computing resources 802.

At step 1202, batches of performance data are tagged with exercise identifiers (codes, labels, etc.). Each batch of performance data may have one exercise identifier identifying the type of exercise (e.g., squat, row, bench press, etc.) represented by that batch of performance data. The exercise identifier may be included in the other data 908 of the augmented video file 900, for example such that the indication to start or end data collection also includes the exercise identifier. Step 1202 thereby enables each batch of performance data to be associated with a corresponding type of exercise.

At step 1204, batches of performance data with matching exercise identifiers are compared. The exercise identifiers enable the control circuitry 806 and/or the remote computing resource 802 to sort the batches into appropriate buckets, categories, folders, etc. for the different exercise identifiers, i.e., such that batches of performance data with a given exercise identifier (corresponding to a particular type of exercise) are aggregated for comparison and/or other processing. Comparing the batches of performance data can include ranking performances, generating statistical metrics (e.g., averages, percentiles, etc.), etc. As one example, comparing the batches of performance data can include comparing a current user's performance data to previous performances of that user, of all other users, or of a selected subset of users (e.g., users of the same age range, gender, etc.). Various insights, rankings, etc. can be generated in step 1204.

At step 1206, a dashboard of performance comparisons is generated. The dashboard may visualize results of step 1204 for a particular exercise or may visualize results of multiple instances of step 1204 for multiple different types of exercises. For example, step 1206 may show leaderboards of performances on different exercises (e.g., a squat leaderboard, a bench press leaderboard, and a rowing leaderboard) that illustrate a ranking of performances by the user and/or other users. As another example, the dashboard may provide the user with percentiles or rankings of the user's performances in different exercises relative to peer users (e.g., similar age, gender, other category). Such dashboards may enable a user to determine weak spots for additional focus in future workouts (e.g., exercises where the user has a lower ranking as compared to rankings in other exercises).

At step 1208, the dashboard is updated based on selected filters. For example, the user may select to filter the data shown on the dashboard to only show data from the user's own performances or from a subset of users (e.g., one particular other person, a set of the user's personal connections, people from the user's geographic area, members of the user's gym, users in a selectable age range). The dashboard then updates any rankings, percentiles, comparisons, visualizations, etc. to show the user's performances compared to the filtered dataset. This approach to data filtering and exercise-specific performance data provides highly-detailed data to a user that can help the user (or a coach, trainer, etc.) customize future workout plans while also providing competitive motivation and other advantages.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

[References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure (e.g., including the controller(s) discussed herein) may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

What is claimed is:

1. An exercise apparatus, comprising:

a motor configured to generate a force experienced by a user of the exercise apparatus;

a video monitor; and circuitry configured to:

obtain an augmented video file from a remote streaming service, wherein the augmented video file comprises a video and a plurality of settings, wherein the augmented video file associates the plurality of settings with a plurality of time steps during a runtime of the video, wherein the augmented video file further comprises a first indication of a first moment during the runtime of the video at which to initiate collection of user performance data and a second indication of a second moment during the runtime of the video at which to end collection of user performance data;

cause the video monitor to display the video;

at each of the plurality of time steps during the runtime of the video, control the motor in accordance with the setting associated with the time step; and collect, based on the first indication and the second indication, a batch of the user performance data associated with a subperiod of the runtime, the subperiod running from the first moment to the second moment.

2. The exercise apparatus of claim 1, wherein the circuitry is configured to control the motor in accordance with the setting associated with the time step by populating a value of a control variable based on the control setting from the augmented video file and controlling the motor using the value of the control variable.

3. The exercise apparatus of claim 2, wherein the circuitry is further configured to adjust the value of the control variable based on a user input.

4. The exercise apparatus of claim 1, wherein the plurality of settings are integrated with the video in the augmented video file such that:

a first setting is read by the circuitry when the video plays to a first time step of the plurality of time steps, the first time step associated with the first setting; and a second setting of the plurality of values is read by the circuitry when the video plays to a second time step of the plurality of time steps, the second time step associated with the second setting.

5. The exercise apparatus of claim 1, wherein the circuitry is configured to control the motor in accordance with the setting by populating a setpoint for the motor based on the setting and a user-specific scaling factor.

6. The exercise apparatus of claim 5, wherein the user-specific scaling factor indicates a fitness level of the user.

7. The exercise apparatus of claim 6, wherein the user-specific scaling factor indicates a one rep max of a user, the setting indicates a percentage, the circuitry is configured to determine a setpoint for the force by multiplying the one rep max by the percentage, and the circuitry is configured to control the motor to drive the force to the setpoint.

8. The exercise apparatus of claim 1, further comprising a repositionable terminal between the motor and the user, wherein the augmented video file further comprises an indication that the repositionable terminal should be repositioned at a particular time step in the runtime of the video, wherein the circuitry is configured to control the motor to facilitate repositioning of the repositionable terminal when the video plays to the particular time step.

9. The exercise apparatus of claim 8, further comprising a frame and a cable coupled to the motor, wherein the repositionable terminal affects a position from which the cable extends from the frame, and wherein controlling the motor to facilitate repositioning of the repositionable terminal comprises operating the motor to prevent slack in the cable or controlling the motor to prevent the motor from resisting movement of the cable caused by the repositioning of the repositionable terminal.

10. The exercise apparatus of claim 1, wherein the augmented video file further comprises a third indication of a third moment during the runtime of the video at which to initiate collection of user performance data, the third moment after the second moment; and wherein the circuitry is configured to initiate collection of an additional batch of the user performance data at the third moment based on the third indication, wherein the circuitry abstains from collecting the user performance data between the second moment and the third moment.

11. The exercise apparatus of claim 1, wherein the circuitry is further configured to encode the batch of user performance data with an indicator of an associated type of exercise and upload the batch of the user performance data to a remote server responsive to reading the second indication from the augmented video file.

12. The exercise apparatus of claim 1 wherein:

the augmented video file further comprises a plurality of control logic selections associated with the plurality of time steps during the runtime of the video, each control logic selection indicating a selection of a control logic from a set of available control logic; and wherein the circuitry is configured to control, at each of the plurality of time steps during the runtime of the video, the motor by executing the control logic indicated by the control logic selection associated with the time step.

13. The exercise apparatus of claim 12, wherein the set of available control logic comprises:

first control logic causing the circuitry to control the motor to cause the force to be constant; and second control logic causing the circuitry to control the motor to cause the force to be greater during an eccentric phase of an exercise compared to a concentric phase of the exercise.

14. A system, comprising:

an exercise apparatus comprising a video monitor, a motor configured to generate a force experienced by a user of the exercise apparatus, and circuitry configured to control the motor; and a database storing a plurality of augmented video files each comprising a video and settings associated with a plurality of time steps during a runtime of the video;

wherein the circuitry is further configured to stream the plurality of augmented video files from the database, cause the video monitor to display the videos, and control the motor at the plurality of time steps during the runtime of the videos in accordance with the settings associated with the plurality of time steps, wherein the settings indicate a selection between a first control logic and a second control logic, wherein the circuitry is configured to control the motor in accordance with the second control logic by causing the motor to provide a first force during an eccentric phase of an exercise and a second force during a concentric phase of an exercise.

15. The system of claim 14, wherein the database is located remotely from the exercise apparatus and the circuitry is communicable with the database via the internet.

16. The system of claim 14, wherein the settings are integrated with the videos in the augmented video files such that:

a first setting is read by the circuitry when a first video of a first augmented video file plays to a first time step of the plurality of time steps, the first time step associated with the first setting; and a second setting is read by the circuitry when the first video plays to a second time step of the plurality of time steps, the second time step associated with the second setting.

17. The system of claim 14, wherein the circuitry is configured to control the motor using settings by calculating a setpoint for the motor based on a current setting of the settings and a user-specific scaling factor.

18. The system of claim 17, wherein the user-specific scaling factor indicates a fitness level of the user.

19. The system of claim 17, wherein the database further stores a plurality of user profiles for a plurality of users, the plurality of user profiles comprising values of the user-specific scaling factor for the plurality of users.

20. The system of claim 14, wherein the circuitry uses the settings to populate target values of the force used as control setpoints.

* * * * *